United States Patent [19]

Noguchi et al.

[11] Patent Number: 5,024,269

[45] Date of Patent: Jun. 18, 1991

[54] LAMINATED HEAT EXCHANGER

[75] Inventors: Ichiro Noguchi; Futoshi Nakata, both of Konan, Japan

[73] Assignee: Zexel Corporation, Tokyo, Japan

[21] Appl. No.: 573,060

[22] Filed: Aug. 24, 1990

[30] Foreign Application Priority Data

Aug. 24, 1989 [JP] Japan ..... 1-98942
Nov. 30, 1989 [JP] Japan ..... 1-310910

[51] Int. Cl.[5] ..... F28D 1/03
[52] U.S. Cl. ..... 165/153; 165/176
[58] Field of Search ..... 165/150, 153, 176, 167

[56] References Cited

U.S. PATENT DOCUMENTS 3,258,832 7/1966 Gerstung ..... 165/176
4,217,953 8/1980 Sonoda et al. ..... 165/153
4,274,482 6/1981 Sonoda ..... 165/153
4,621,685 11/1986 Nozawa ..... 165/153
4,696,342 9/1987 Yamauchi et al. ..... 165/153

FOREIGN PATENT DOCUMENTS 193589 8/1989 Japan ..... 165/176

*Primary Examiner*—John Rivell
*Assistant Examiner*—L. R. Leo
*Attorney, Agent, or Firm*—Wenderoth, Lind & Ponack

[57] ABSTRACT

A laminated heat exchanger for used in automobile air-conditioners includes a plurality of heat exchanger elements laminated together and each having a pair of tanks on one side thereof and connected by a U-shaped channel. The heat exchanger elements are communicated with each other so as to form a flow passage having at least four paths. An inlet and an outlet pipe are disposed in juxtaposition on one side of the laminated heat exchanger which is out of alignment with the path of flow of air to be cooled.

16 Claims, 17 Drawing Sheets

LAMINATED HEAT EXCHANGER

BACKGROUND OF THE INVENTION

1. Field of the Invention

The present invention relates to heat exchangers such as laminated evaporators for used in automobile air-conditioners, and more particularly to a laminated heat exchanger composed a multiplicity of laminated heat exchanger elements having pairs of tanks at one side thereof and communicated together by U-shaped flow passages or channels.

2. Description of the Prior Art

One known laminated evaporator is disclosed in Japanese Patent Laid-open Publication No. 61-184394 in which an inlet pipe and an outlet pipe are connected to the front of an evaporator body as viewed from the direction of flow of air to be cooled.

The inlet and outlet pipes connected to the front of the evaporator body is disposed in the air flow passage and hence forms an obstacle or resistance to the flow of air which will lower the cooling power of the evaporator. Furthermore, since the inlet and outlet pipes are provided with pressure reducing valves and the like, the location of these pipes in the air flow passage results in an obstructed flow of air to be cooled through the air flow passage.

Japanese Utility Model Laid-open Publication No. 60-154774 discloses an arrangement which comprises an inlet pipe and an outlet pipe disposed on opposite sides of an evaporator body. With the inlet and outlet pipes disposed on the different sides, the evaporator requires a complicated arrangement for connection with a related devices and also needs a wasteful room for installation thereof.

It is therefore desired that inlet and outlet pipes are disposed on one side of an evaporator body in side-by-side.

In an evaporator having a so-called "two-path" flow pattern wherein a refrigerant flows from one of a pair of laterally spaced tanks to the opposite tank through a U-shaped flow passage or channel, the inlet and outlet pipes can be disposed on one side of the evaporator body in side by side. In a large-sized evaporator, the two-path flow pattern is however unable to provide an adequate heat exchanging efficiency. It is therefore desirable for the evaporator to have a flow pattern having at least four flow paths. In order to form a refrigerant flow passage having at least four paths, the inlet and outlet pipes must be disposed on opposite sides of the evaporator body. Thus, the side-by-side arrangement of the inlet and outlet pipes becomes impossible again.

SUMMARY OF THE INVENTION

With the foregoing difficulties in view, it is an object of the present invention to provide a laminated heat exchanger which has an internal refrigerant flow passage having at least four paths and includes inlet and outlet pipes disposed on one side of a body of the heat exchanger.

A first aspect of the present invention provides a laminated heat exchanger which comprises: a plurality of first heat exchanger elements, each of the first heat exchanger element including a pair of first and second tanks, a first U-shaped channel interconnecting the first and second tanks, and a central third tank disposed between the first and second tanks and separated from the first and second tanks; a plurality of second heat exchanger elements, each of the second heat exchanger element including a pair of fourth and fifth tanks, a second U-shaped channel interconnecting the fourth and fifth tanks, and a central sixth tank disposed between the fourth and fifth tanks and communicating with one of the fourth and fifth tanks; and a plurality of corrugated fins; the first heat exchanger elements and a part of the plural corrugated fins being laminated alternately, with the first tanks, second tanks and third tanks of each adjacent pair of the laminated first heat exchanger elements communicating with each other, the laminated first heat exchanger elements having a first internal refrigerant flow passage extending between the first and second tanks and having a forward path and a return path; the second heat exchanger elements and the remainder of the corrugated fins being laminated alternately, with the fourth tanks, fifth tanks and sixth tanks of each adjacent pair of the laminated second heat exchanger elements communicating with each other, the laminated second heat exchanger elements having a second internal refrigerant flow passage extending between the fourth and fifth tanks and having a forward path and a return path; the laminated first heat exchanger elements and the laminated second heat exchanger elements being connected end to end, with the third tank of an endmost one of the laminated first heat exchanger elements communicating with the sixth tank of a confronting one of the laminated second heat exchanger elements so that the third and sixth tanks jointly forming a group of central tanks connected in series; one of the first and second tanks of the endmost first heat exchanger element communicating with the other of the fourth and fifth tanks of the confronting second heat exchanger element to connect the first and second internal refrigerant flow passages in series to thereby form a combined refrigerant flow passage having two forward paths and two return paths, the combined refrigerant flow passage being connected at one end with an end of the group of series-connected central tanks.

With this construction, the first heat exchanger elements laminated with the corrugated fins and the second heat exchanger elements laminated with the corrugated fins each constitute a group of heat exchanger elements having an internal refrigerant flow passage having two paths (forward and return paths). By combining these groups of heat exchanger elements in such a manner as to connect the forward and return paths in series, it is possible to construct a flow passage including at least four paths whose number is a multiple of 2. One end of the flow passage is connected with one end of a series-connected central tanks so that an inlet pipe and an outlet pipe are disposed in juxtaposition on one side of the laminated heat exchanger.

A second aspect of the invention provides a laminated heat exchanger which comprises: a plurality of first heat exchanger elements, each of the first heat exchanger element including a pair of first and second tanks, a first U-shaped channel interconnecting the first and second tanks, and a pair of aligned first pipe-receiving holes disposed between the first and second tanks and separated from the first and second tanks; a plurality of second heat exchanger elements, each of the second heat exchanger element including a pair of fourth and fifth tanks, a second U-shaped channel interconnecting the fourth and fifth tanks, and a pair of aligned second pipe-receiving holes formed in one of the fourth and fifth tanks; a plurality of corrugated fins; the first heat exchanger elements and a part of the plural corrugated fins being laminated alternately, with the first tanks and second tanks of each adjacent pair of the laminated first heat exchanger elements communicating with each other, and also with the first pipe-receiving holes of each adjacent pair of the laminated first heat exchanger elements aligned with each other, the laminated first heat exchanger elements having a first internal refrigerant flow passage extending between the first and second tanks and having a forward path and a return path; the second heat exchanger elements and the remainder of the corrugated fins being laminated alternately, with the fourth tanks and fifth tanks of each adjacent pair of the laminated second heat exchanger elements communicating with each other, and also with the second pipe-receiving holes aligned with each other, the laminated second heat exchanger elements having a second internal refrigerant flow passage extending between the fourth and fifth tanks and having a forward path and a return path; the laminated first heat exchanger elements and the laminated second heat exchanger elements being connected end to end, with the first and second pipe-receiving holes aligned one another to form a series of pipe-receiving holes; one of the first and second tanks of the endmost first heat exchanger element communicating with the other of the fourth and fifth tanks of the confronting second heat exchanger element to connect the first and second internal refrigerant flow passages in series to thereby form a combined refrigerant flow passage having two forward paths and two return paths; and an inlet/outlet pipe extending through the series of pipe-receiving holes and connected at its one end to one end of the combined refrigerant flow passage.

With this construction, the first heat exchanger elements laminated with the corrugated fins and the second heat exchanger elements laminated with the corrugated fins each constitute a group of heat exchanger elements having an internal refrigerant flow passage having two paths (forward and return paths). By combining these groups of heat exchanger elements in such a manner as to connect the forward and return paths in series, it is possible to construct a flow passage including at least four paths whose number is a multiple of 2. One end of the flow passage is connected with one end of an inlet/outlet pipe extending through the pipe-receiving holes so that an inlet pipe and an outlet pipe are disposed in juxtaposition on one side of the laminated heat exchanger.

A third aspect of the invention provides a laminated heat exchanger which comprises: a multiplicity of heat exchanger elements each including a pair of first and second tanks, a U-shaped channel interconnecting the first and second tanks, and a central third tank disposed between the first and second tanks and separated from the first and second tanks; a plurality of corrugated fins laminated alternately with the heat exchanger elements; two end plates disposed on two endmost ones of the laminated heat exchanger elements, respectively; the laminated heat exchanger elements being composed of plural groups of heat exchanger elements which are connected by the first tanks and second tanks of each adjacent pair of the heat exchanger elements adequately communicating with each other so that each of the group of heat exchanger elements has a internal refrigerant flow passage extending between the first and second tanks and having a forward path and a return path; the third tanks of all the groups of heat exchanger elements being communicated with each other to form a series of central tanks; one of the first tank and the second tank of an endmost one of the heat exchanger element of one group of heat exchanger elements communicating with a corresponding one of the first tank and the second tank of a confronting one of the heat exchanger element of an adjacent group of heat exchanger elements so as to connect the internal refrigerant flow passages of the respective groups of heat exchanger elements in series to form a combined refrigerant flow passage; and means on one of the end plates for connecting one end of the combined refrigerant flow passage and one end of the series of central tanks in series.

With this construction, the heat exchanger elements laminated with the corrugated fins are separated into plural groups. Each group of heat exchanger elements includes an internal refrigerant flow passage having two paths (forward and return paths). By combining the plural groups of heat exchanger elements in such a manner as to connect the forward and return paths in series, it is possible to construct a flow passage including at least four paths whose number is a multiple of 2. One end of the flow passage is connected with one end of a series-connected central tanks by means of a connecting means which is disposed on one of the end plates so that an inlet pipe and an outlet pipe are disposed in juxtaposition on one side of the laminated heat exchanger.

A fourth aspect of the invention provides a laminated heat exchanger which comprises: a multiplicity of heat exchanger elements each including a pair of first and second tanks, a U-shaped channel interconnecting the first and second tanks, and a pair of aligned pipe-receiving openings disposed between the first and second tanks; a plurality of corrugated fins laminated alternately with the heat exchanger elements; two end plates disposed on two endmost ones of the laminated heat exchanger elements, respectively; the laminated heat exchanger elements being composed of plural groups of heat exchanger elements which are connected by the first tanks and second tanks of each adjacent pair of the heat exchanger elements adequately communicating with each other so that each of the group of heat exchanger elements has a internal refrigerant flow passage extending between the first and second tanks and having a forward path and a return path, and the pipe-receiving openings of the groups of heat exchanger elements are aligned with one another; one of the first tank and the second tank of an endmost one of the heat exchanger element of one group of heat exchanger elements communicating with a corresponding one of the first tank and the second tank of a confronting one of the heat exchanger element of an adjacent group of heat exchanger elements so as to connect the internal refrigerant flow passages of the respective groups of heat exchanger elements in series to form a combined refrigerant flow passage; an inlet/outlet pipe extending through the aligned pipe-receiving openings; means on one of the end plates for connecting one end of the combined refrigerant flow passage and one end of the inlet/outlet pipe.

The laminated heat exchanger according to the fourth aspect differs from the laminated heat exchanger of the third aspect in that the inlet/outlet pipe is provided in place of the series-connected central tanks. One end of the internal refrigerant flow passage and one end of the inlet/outlet pipe are connected by the connecting means disposed on one of the end plate.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

The present invention will be described hereinbelow in greater detail with reference to certain preferred embodiments shown in the accompanying drawings.

Figure 1:
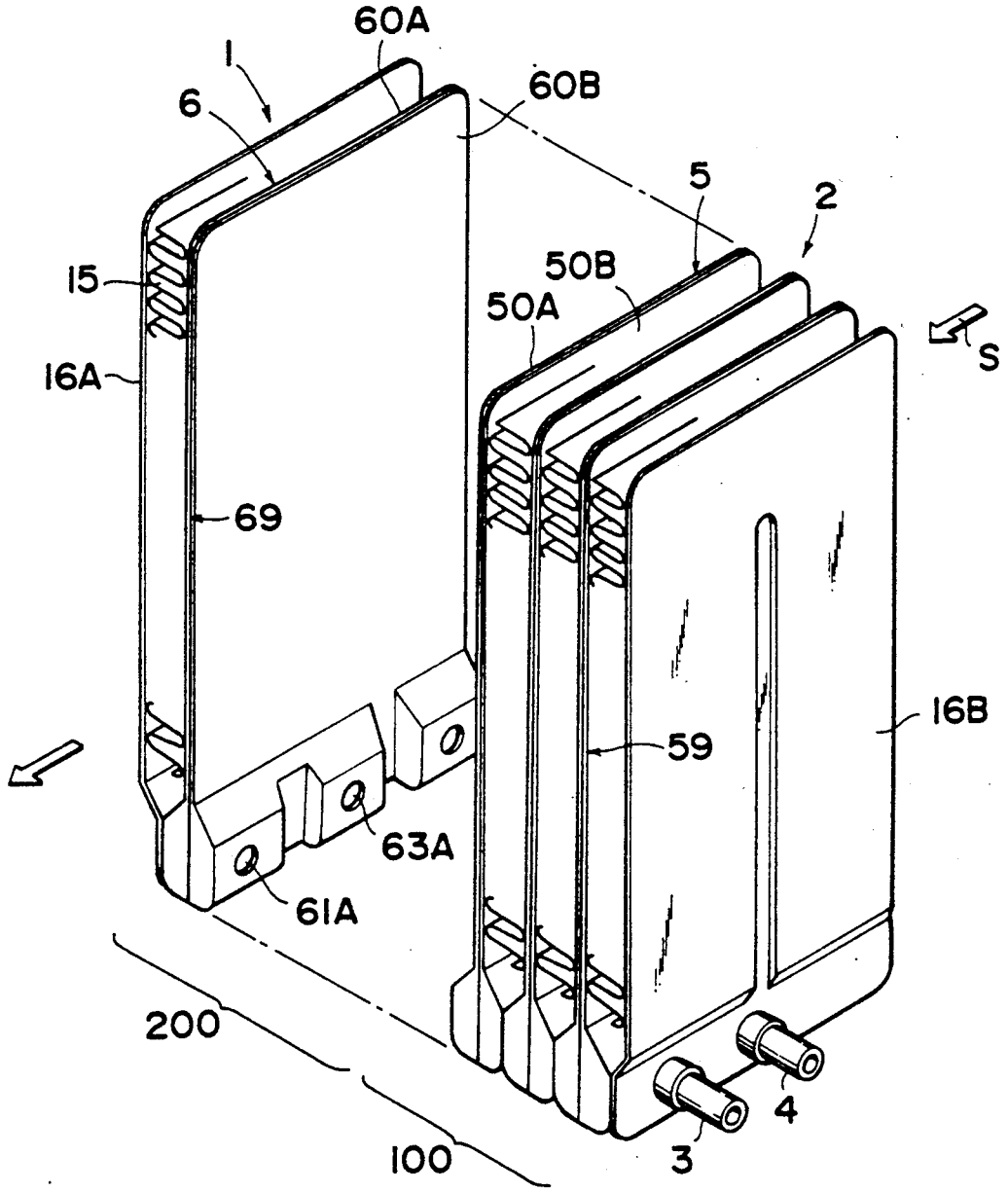
FIG. 1 is a schematic perspective view of a laminated heat exchanger according to a first embodiment of the present invention.

FIG. 1 shows a laminated heat exchanger (hereinafter referred to as "heat exchanger") according to a first embodiment of the invention, the heat exchanger having a flow passage of a four-path pattern. The heat exchanger 1 includes a body 2, an inlet pipe 3 for supplying a refrigerant into the heat exchanger body 2, and an outlet pipe 4 for discharging the refrigerant from the heat exchanger body 2. The inlet and outlet pipes 3, 4 are connected to one side of the heat exchanger body 2 and they are interchangeable in function. The heat exchanger body 2 and the inlet and outlet pipes 3, 4 are joined together by brazing in an oven.

The heat exchanger body 2 is composed of a plurality of first heat exchanger elements 5 laminated together with corrugated fins 15 disposed therebetween, and a plurality of second heat exchanger elements 6 laminated together with corrugated fins 15 disposed therebetween. The laminated first heat exchanger elements 5 and the laminated second heat exchanger elements 6 are connected together end to end, and two end plates 16A, 16B are disposed respectively on the outermost first heat exchanger element 5 and the outermost second heat exchanger element 6.

Figure 2:
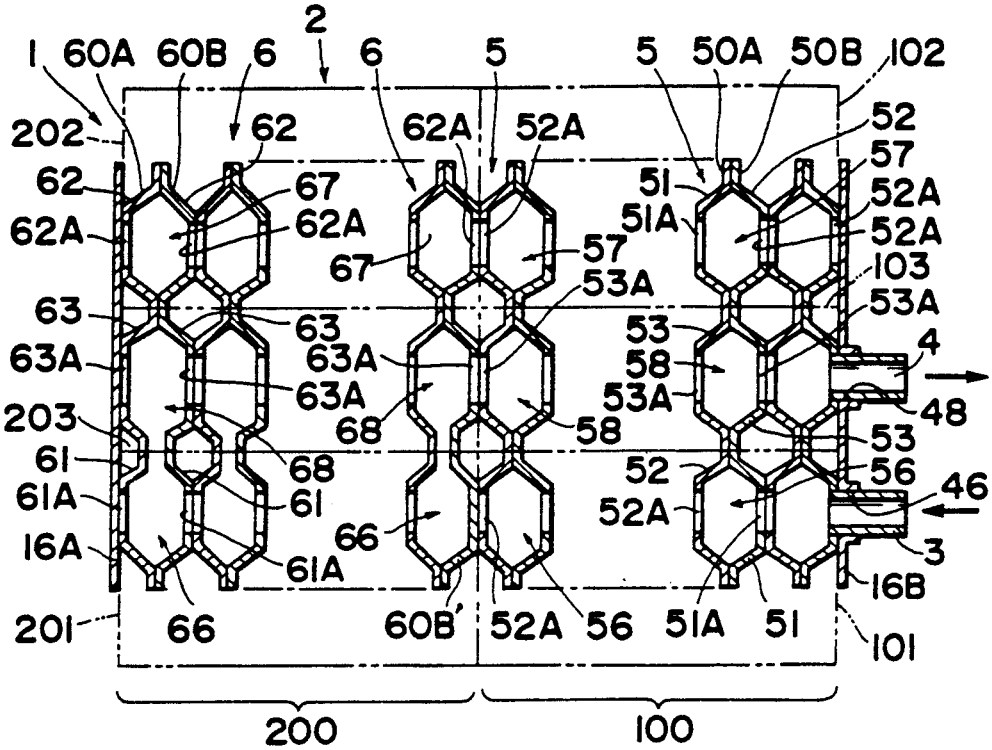
FIG. 2 is a horizontal cross-sectional view of the heat exchanger showing the construction of tanks.
Figure 3:
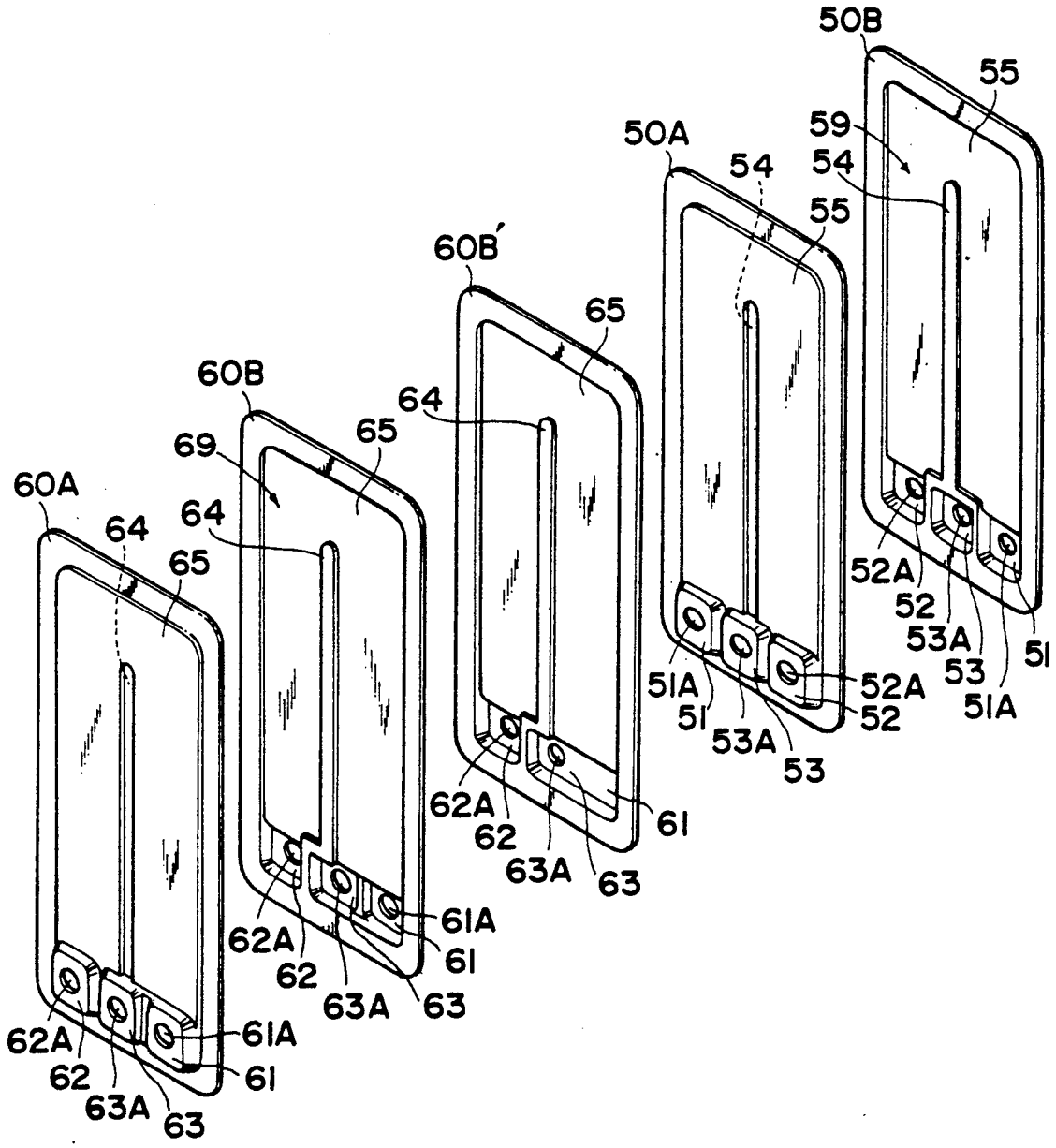
FIG. 3 is an exploded perspective view of heat exchanger elements composed of pairs of press-formed plates adapted to be laminated together to form the heat exchanger.

As shown in FIGS. 2 and 3, each of the first heat exchanger elements 5 is composed of a pair of stamped or otherwise press-formed elongate plates 50A and 50B joined together in face-to-face confrontation. Likewise, each of the second heat exchanger elements 6 is composed of a pair of stamped or otherwise press-formed elongate plates 60A and 60B joined together in face-to-face confrontation.

Each of the press-formed elongate plates 50A, 50B is swelled along its lower end edge so as to form three recesses 51, 52, 53. The plate 50A, 50B has a longitudinal ridge 54 extend from the central recess 53 toward the opposite end edge thereof, and a U-shaped groove 55 extending between the outer recesses 51, 52 along the periphery of the longitudinal ridge 54. The U-shaped groove 55 is smaller in depth than the recesses 51, 52, 53. Two of such press-formed plates 50A, 50B are joined together in face-to-face confrontation to form one of the first heat exchanger elements 5, as stated above. In the first heat exchanger element 5 thus formed, there are defined a first tank 56 by the opposed recesses 51, 52, a second tank 57 by the opposed recesses 52, 51 and a third tank 58 by the two opposed recesses 53. The third tank 58 is disposed between the first and second tanks 56, 57. There is also defined in the first heat exchanger element 5 a U-shaped channel 59 by two opposed U-shaped grooves 55. The U-shaped channel 59 thus formed extends between the first and second tanks 56, 57 and interconnects them. The central third tank 58 is separated from the first and second tanks 56, 57 as well as the U-shaped channel 59. Each of the recesses 51–53 has a central hole 51A, 52A, 53A so that the respective pairs of tanks 56, 57, 58 of the adjacent heat exchanger elements 5 communicate with each other, respectively, through the holes 51A, 52A, 53A.

Each of the press-formed elongate plates 60A, 60B of the second heat exchanger elements 6 is substantially the same as the plate 50A, 50B excepting that a partition wall between the central recess and one of the outer recesses is lowered to interconnect the central recess and the one outer recess. More specifically, the press-formed elongate plate 60A, 60B is swelled along its lower end edge so as to form three recesses 61, 62, 63. One of the outer recesses 61, 62, that is the recess 61 in the illustrated embodiment, is communicated with the central recess 63. The plate 60A, 60B has a longitudinal ridge 64 extend from the central recess 63 toward the opposite end edge thereof, and a U-shaped groove 65 extending between the outer recesses 61, 62 along the periphery of the longitudinal ridge 64. The U-shaped groove 65 is smaller in depth than the recesses 61, 62, 63. Two of such press-formed plates 60A, 60B are joined together in face-to-face confrontation to form one of the second heat exchanger elements 6, as stated above. In the second heat exchanger element 6 thus formed, there are defined a fourth tank 66 by the two opposed recesses 61, a fifth tank 67 by the two opposed recesses 62, and a sixth tank 68 by the two opposed recesses 63. The sixth tank 68 is disposed between the fourth and fifth tanks 66, 67. There is also defined in the second heat exchanger element 6 a second U-shaped channel 69 by two opposed U-shaped grooves 65. The U-shaped channel 69 thus formed extends between the fourth and fifth tanks 66, 67 and interconnects them. The fourth tank 66 communicates with the central sixth tank 68. Each of the recesses 61–63 has a central hole 61A, 62A, 63A so that the respective pairs of tanks 66, 67, 68 of the adjacent heat exchanger elements 6 communicate with each other, respectively, through the holes 61A, 62A, 63A.

In the heat exchanger body 2, the first and second heat exchanger elements 5, 6 are arranged as shown in FIG. 2; that is, the heat exchanger body 2 is composed of a group of first heat exchanger elements 100 and a group of second heat exchanger elements 200 separated from the center of the heat exchanger body 2.

The first heat exchanger element group 100 includes solely the first heat exchanger elements 5 laminated together and includes a first tank group 101 (composed of the first tanks 56 of the respective elements 5), a second tank group 102 (composed of the second tanks 57 of the respective elements 5), and a central tank group 103 (composed of the third tanks 58 of the respective elements 5). The U-shaped channels 59 of the respective elements 5 define a flow passage having two paths (a forward path and a return path) extending between the first and second tank groups 101, 102. The second heat exchanger element group 200 includes solely the second heat exchanger elements 6 laminated together and includes a fourth tank group 201 (composed of the fourth tanks 66 of the respective elements 6), a fifth tank group 202 (composed of the fifth tanks 67 of the respective elements 6), and a central tank group 203 (composed of the sixth tanks 68 of the respective elements 6). The U-shaped channels 69 of the respective elements 6 define a flow passage having two paths (a forward path and a return path) extending between the fourth and fifth tank groups 201, 202. The second tank group 102 of the first heat exchanger element group 100 and the fifth tank group 202 of the second heat exchanger element group 200 are connected together via two adjacent tanks 57, 67 so that the respective two-path flow passages of the first and second heat exchanger element groups 100, 200 are connected in series and jointly constitute a combined refrigerant flow passage having four paths. The fourth tank group 201 is connected to one end of a central tank group 203 so that the four-path refrigerant flow passage is connected at one end to the tank group 203. The first tank group 101 is connected to the inlet pipe 3 so that the four-path refrigerant flow passage is connected at the opposite end to the inlet pipe 3. The opposite end of the central tank group 103 is connected to the outlet pipe 4. The first and third tank groups 101, 201 are separated from one another by a stamped or otherwise press-formed elongate plate. In the illustrated embodiment, this plate is comprised of a plate 60B' which is combined with the mating plate 60A and is devoid of a hole 61A. The inlet pipe 3 and the outlet pipe 4 are fitted in a refrigerant inlet hole 46 and a refrigerant outlet hole 48, respectively, of the end plate 16B which is disposed on the first heat exchanger element group 100. The inlet and outlet pipes 3, 4 are thus juxtaposed. The end plate 16B closes the second tank 57 of the outermost first heat exchanger element 5 at its outer side, while the opposite end plate 16A closes the fourth, fifth and sixth tanks of the outermost second heat exchanger element 6 at their outer side.

Figure 4:
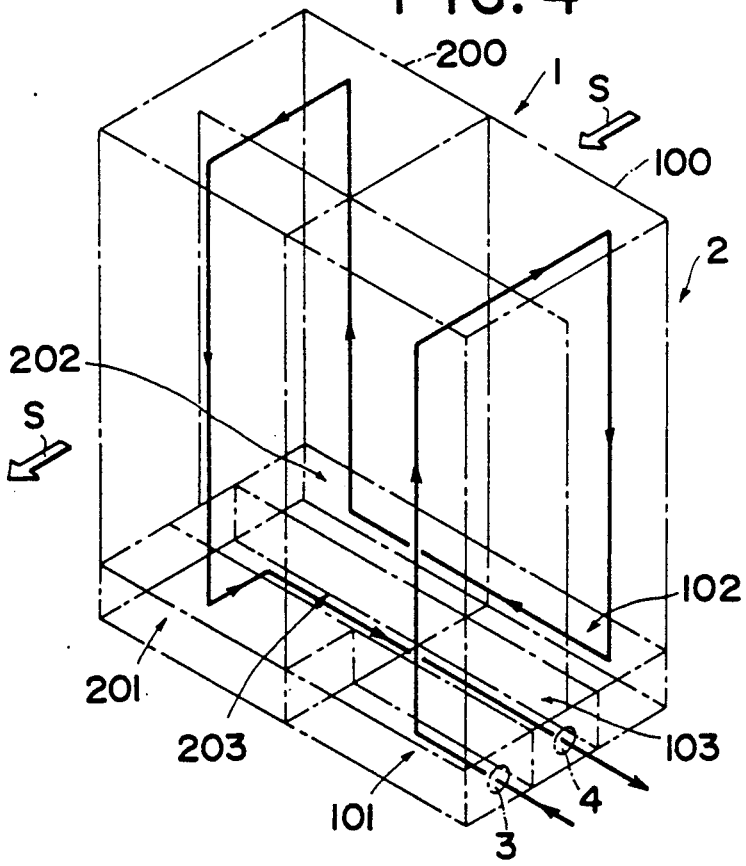
FIG. 4 is a diagrammatical view showing the flow of a refrigerant (fluid) provided in the heat exchanger.

With the heat exchanger 1 thus assembled, as shown in FIG. 4, the refrigerant supplied from the inlet pipe 3 into the first tank group 101 of the first heat exchanger element group 100 flows through the U-shaped channels 59 into the second tank group 102 from which the refrigerant horizontally moves to the fifth tank group 202 of the second heat exchanger element group 200. Subsequently, the refrigerant flows through the U-shaped channels 69 into the fourth tank groups 201 from which it flows successively through the sixth central tank group 203 and through the third central tank group 103. Finally, the refrigerant is discharged from the outlet pipe 4. The refrigerant as it flows through the heat exchanger 1 advances along a flow passage having four paths. The inlet pipe 3 and the outlet pipe 4 are interchangeable in function so that it is possible to supply the refrigerant from the pipe 4 and then discharge from the pipe 3. The four-path refrigerant flow passage can be formed by merely connecting, in series, the first heat exchanger element group 100 having a two-path flow passage and the second heat exchanger element group 200 having a two-path flow passage. One end of the four-path refrigerant flow passage is connected to the third and sixth central tank groups 103, 203 so that the inlet and outlet pipes 3, 4 are disposed in juxtaposition on one side of the heat exchanger 1.

Figure 5:
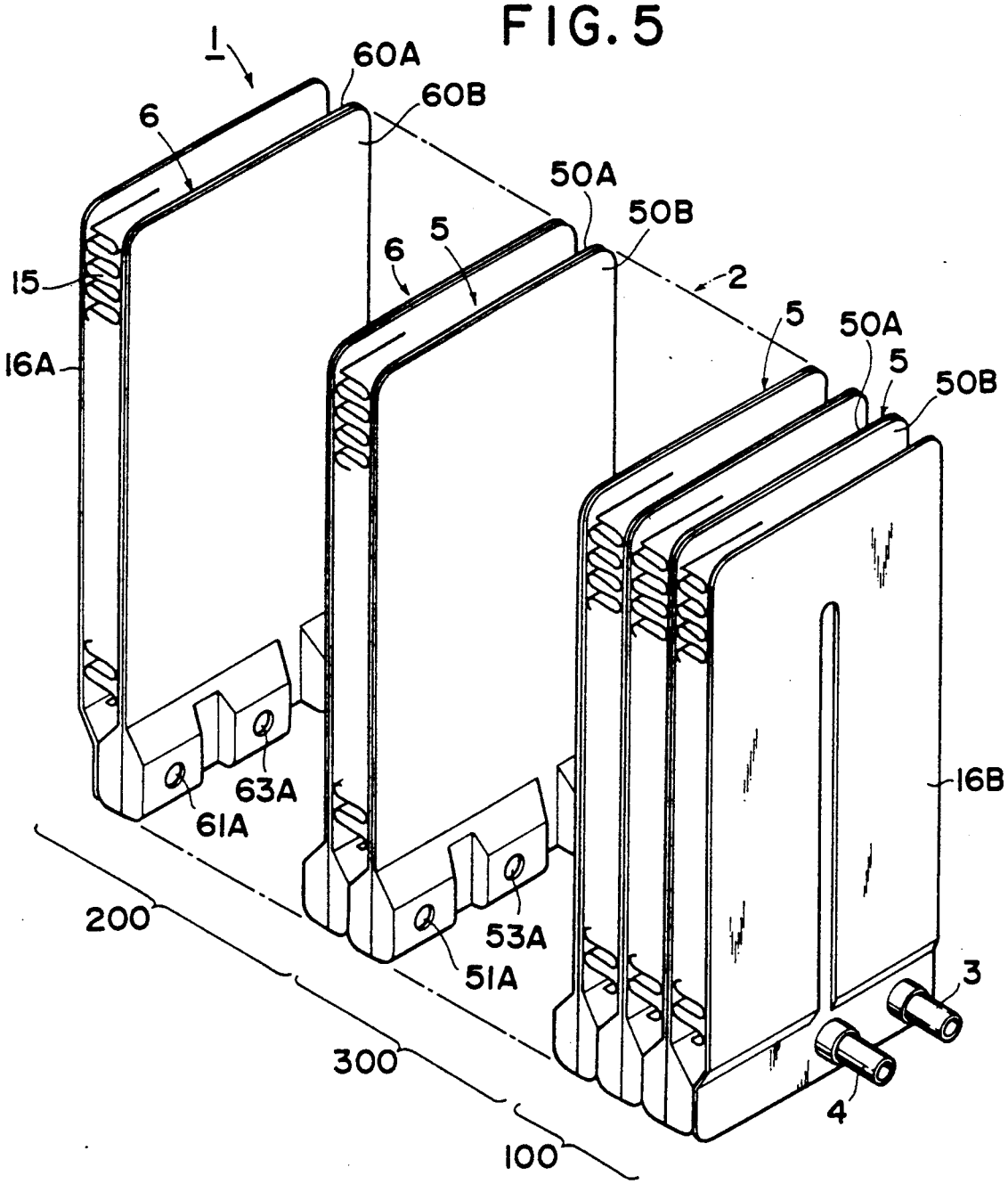
FIG. 5 is a schematic perspective view of a laminated heat exchanger according to a second embodiment of the invention.
Figure 6:
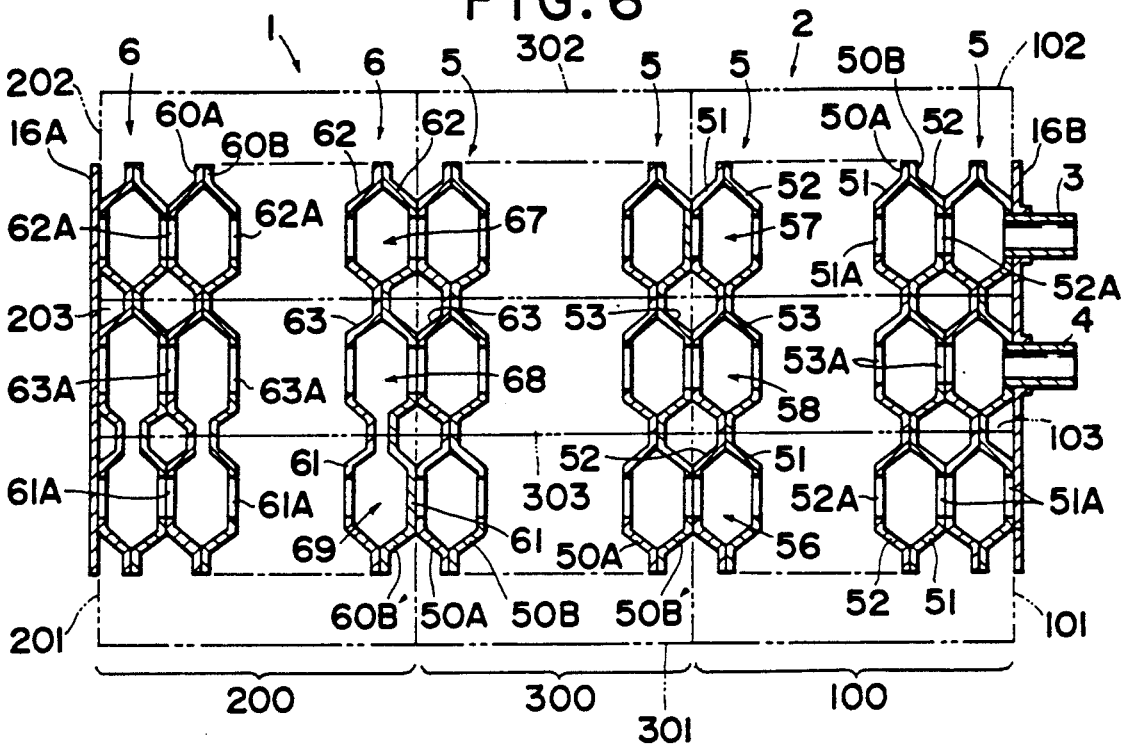
FIG. 6 is a horizontal cross-sectional view of the heat exchanger shown in FIG. 5 illustrative of the construction of tanks.
Figure 7:
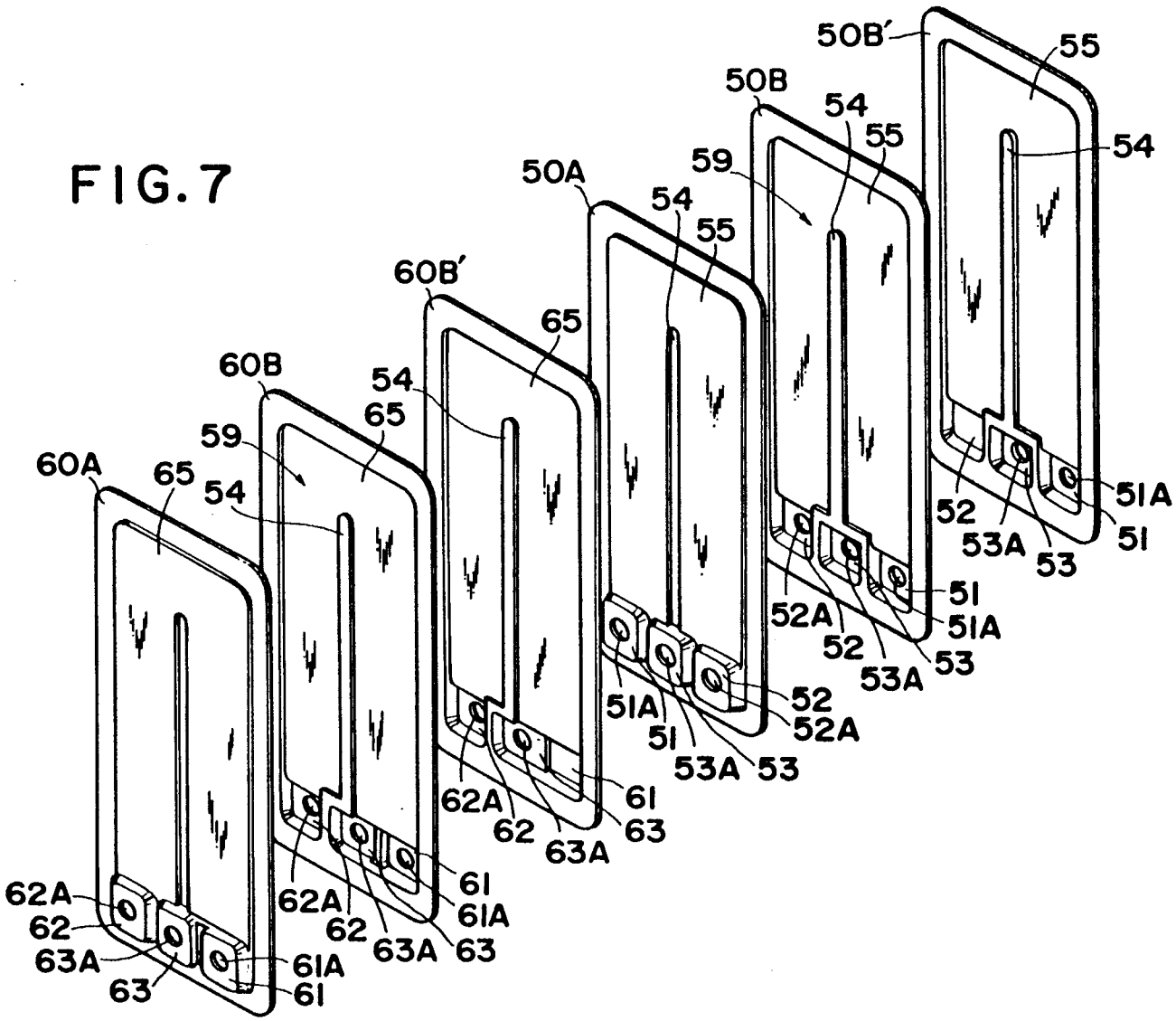
FIG. 7 is an exploded perspective view of heat exchanger elements composed of pairs of press-formed plates adapted to be assembled in layerwise to constitute the heat exchanger shown in FIG. 5.

FIGS. 5 through 7 shows a modified heat exchanger having a six-path refrigerant flow passage. These parts which are identical to those of the first embodiment shown in FIGS. 1–4 are designated by identical reference characters.

The modified heat exchanger 1 differs from the heat exchanger 1 shown in FIG. 1 in that a third heat exchanger element group 300 is added to the four-path heat exchanger element body 2 of the first embodiment.

The third heat exchanger element group 300 likes the first heat exchanger element group 100 and hence includes a seventh tank group 301 (composed of the tanks 56 of the respective heat exchanger elements 5), an eighth tank group 302 (composed of the tanks 57 of the heat exchanger elements 5), and a ninth central tank group 303 (composed of the tanks 58 of the respective heat exchanger elements 5). The U-shaped channels 59 of the respective heat exchanger elements 5 forms a refrigerant flow passage having two paths (a forward path and a return path) and extending between the seventh and eighth tank groups 301, 302.

The third heat exchanger element group 300 is assembled with the heat exchanger element body 2 such that the first tank group 101 of the first heat exchanger element group 100 and the seventh tank group 301 are connected while the eighth tank group 302 and the second tank group 102 of the first heat exchanger element group 100 are connected. The two-path refrigerant flow passages of the respective heat exchanger elements 100, 200, 300 are connected in series to thereby form a refrigerant flow passage having six paths, while the third, sixth and ninth central tank groups 103, 203, 303 are connected together. The fourth tank group 201 of the second heat exchanger element group 200 is connected with the sixth central tank group 203 (composed of the sixth central tanks 68 of the second heat exchanger elements 6), thereby connect the central tank groups 203, 303, 103 and the six-path refrigerant flow passage. The second tank groups 102 is connected with the inlet pipe 3. The third central tank group 103 is connected with the outlet pipe 4. The second tank group 102 and the eighth tank group 302 and the seventh tank group 301 and the fourth tank group 201 are separated respectively by two plates. In the illustrated embodiment, these plates are comprised of a stamped or otherwise press-formed elongate plate 50B' which is combined with the mating plate 50A and devoid of the hole 52A, and another stamped or otherwise press-formed elongate plate 60B' which is combined with the mating plate 60A and devoid of the hole 61A, as shown in FIG. 7. Unlike the first embodiment, the inlet pipe 3 is disposed behind the inlet pipe 4 and fitted in the end plate 16B. The end plate 16B closes the first tank 56 of the outermost first heat exchanger element 5 at its outer side.

Figure 8:
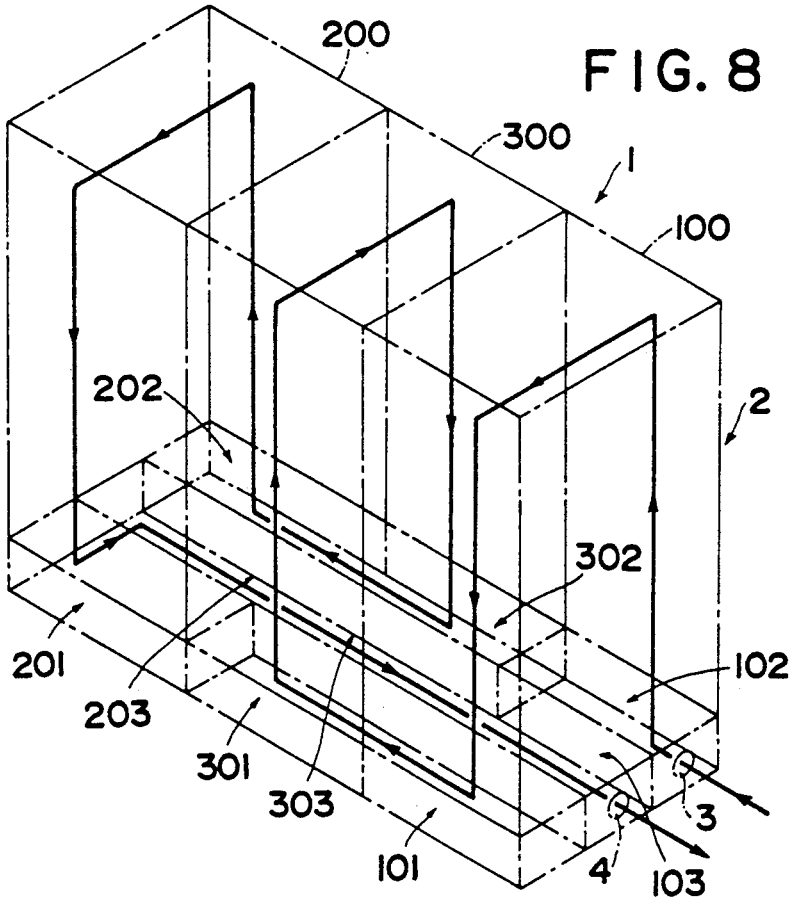
FIG. 8 is a diagrammatical view showing the flow of a refrigerant in the heat exchanger shown in FIG. 5.

With the heat exchanger 1 thus assembled, as shown in FIG. 8, the refrigerant supplied from the inlet pipe 3 into the second tank group 102 of the first heat exchanger element group 100 flows through the U-shaped channels 59 into the first tank group 101 from which the refrigerant horizontally moves to the seventh tank group 301 of the third heat exchanger group 300. Subsequently, the refrigerant flows through the U-shaped channels 59 into the eighth tank group 302 from which it flows horizontally into the fifth tank group 202 of the second heat exchanger element group 200. Thereafter, the refrigerant flow from the fifth tank group 202 through the U-shaped channels 69 into the fourth tank group 201 from which it flows successively through the sixth central tank group 203, through the ninth central tank group 303 and through the third central tank group 103. Finally, the refrigerant is discharged from the outlet pipe 4. The refrigerant as it flows through the heat exchanger 1 advances along a flow passage having six paths. The inlet pipe 3 and the outlet pipe 4 are interchangeable in function so that it is possible to supply the refrigerant from the pipe 4 and then discharge from the pipe 3. The six-path refrigerant flow passage can be formed by merely connecting, in series, the first heat exchanger element group 100 having a two-path flow passage, the third heat exchanger elements 300 having two-path refrigerant flow passage, and the second heat exchanger element group 200 having a two-path flow passage. One end of the six-path refrigerant flow passage is connected to the third, sixth and ninth central tank groups 103, 203, 303 so that the inlet and outlet pipes 3, 4 are disposed in juxtaposition on one side of the heat exchanger 1.

Figure 9:
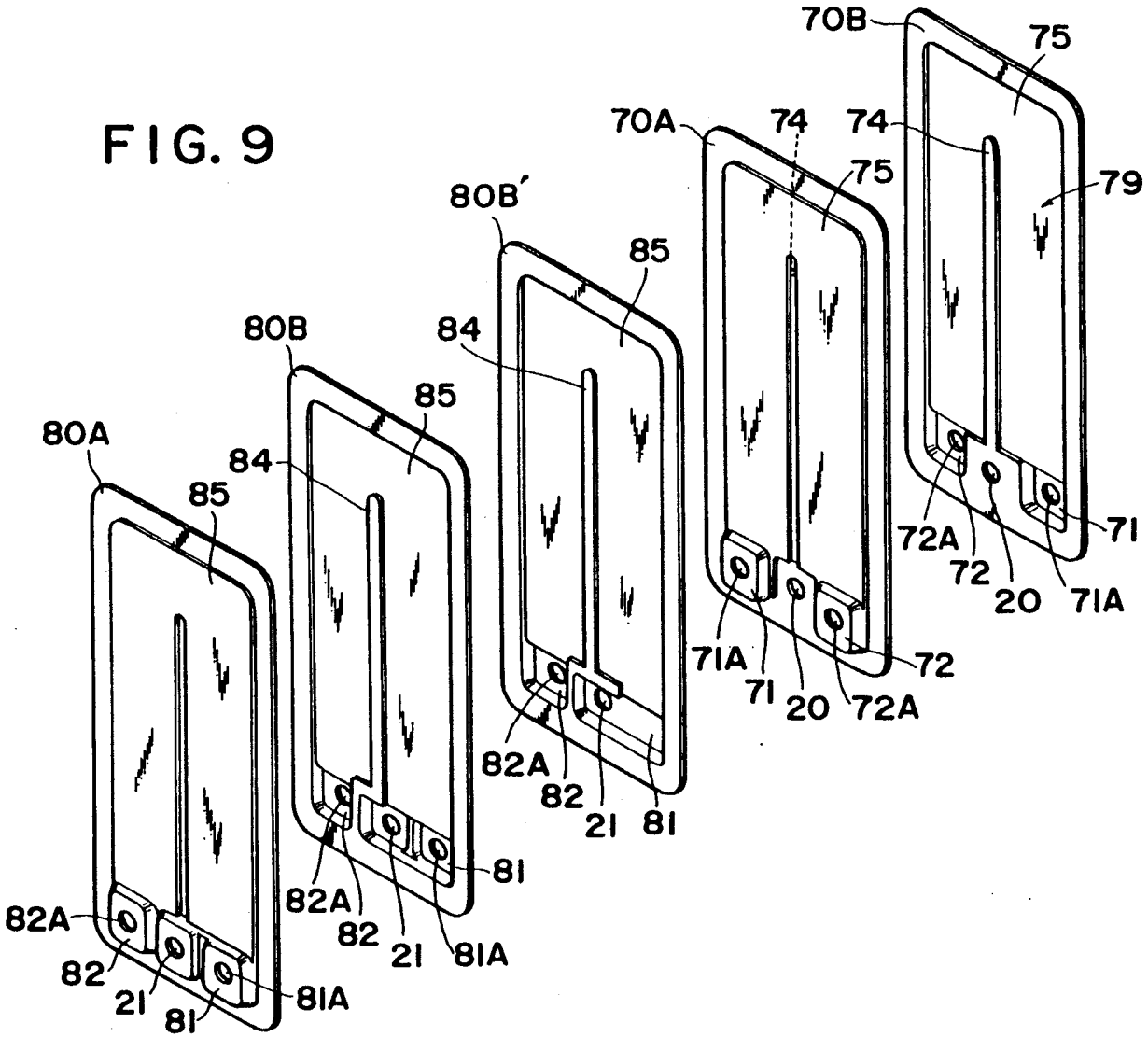
FIG. 9 is an exploded perspective view of heat exchange elements composed of press-formed plates adapted to be assembled layerwise to form a modified laminated heat exchanger.

FIG. 9 shows press-formed plates used for constructing first and second heat exchanger elements 7, 8 (FIG. 10) which are somewhat different from the first and second heat exchanger elements 5, 6 of the foregoing embodiments.

The first heat exchanger element 7 is composed of a pair of press-formed elongate plates 70a, 70B each having a pair of recesses 71, 72 along a lower end edge, and a first pipe-receiving hole 20 disposed between the recesses 71, 72. The pipe-receiving hole 20 is formed in a position which correspond to the position of the central recess 53 of the press-formed plate 50A, 50B of the foregoing embodiments. When the press-formed plates 70A, 70B are joined together in face-to-face confrontation, a first heat exchanger element 7 is formed, which includes a first tank 76 and a second tank 77 formed respectively by the opposed recesses 71, 72 and the opposed recesses 72, 71. The first and second tanks 76, 77 are connected together by a U-shaped channel 79. The pipe-receiving holes 20, 20 of the combined two plates 70A, 70B are aligned and connected end to end.

The second heat exchanger element 8 is composed of a pair of press-formed elongate plates 80A, 80B each having two recesses 81, 82 along a lower end edge. The recess 81 is twice as long as the recess 82 so that the recess 81 includes the central recess 53 and one of the outer recesses 51, 52 of the plate 50A, 50B of the foregoing embodiments. The longer recess 81 has a pipe-receiving hole 21 corresponding in position to the position of the central recess 53 of the plate 50A, 50B of the foregoing embodiments. When the two press-formed plates 80A, 80B are joined together in face-to-face confrontation, a second heat exchanger element 8 is formed, which includes a third tank 86 and a fourth tank 87 formed respectively by the two opposed recesses 81 and the two opposed recesses 82. The third and fourth tanks 86, 87 are connected together by a U-shaped channel 89. The third tank 86 is twice as long as the fourth tank 87. The pipe-receiving holes 21 are aligned with each other.

Figure 10:
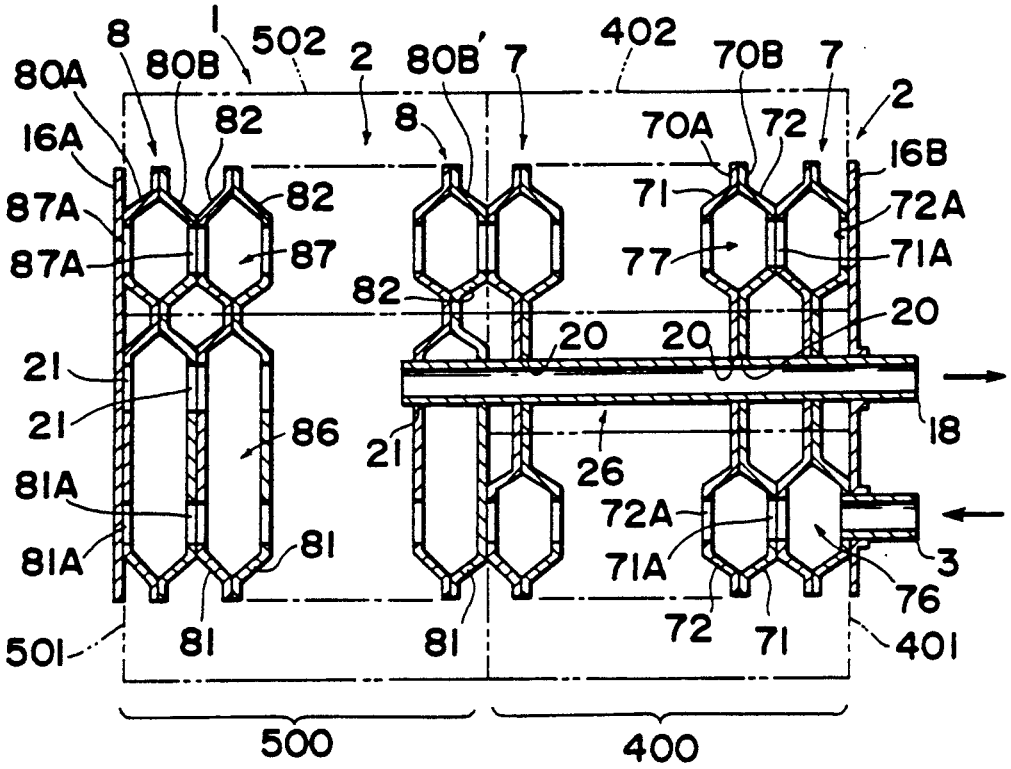
FIG. 10 is a horizontal cross-sectional view showing the construction of tanks of the modified heat exchanger.

FIG. 10 shows a heat exchanger 1 having a four-path refrigerant flow passage which is constructed by using the first and second heat exchanger elements 7, 8. Likewise the four-path heat exchanger shown in FIG. 2, this heat exchanger 1 has a heat exchanger body 2 composed of a group of first heat exchanger elements 400 and a group of second heat exchanger elements 500 separated from the center of the heat exchanger body 2.

The first heat exchanger element group 400 includes solely the first heat exchanger elements 7 laminated together and includes a first tank group 401 (composed of the first tanks 76 of the respective elements 7), a second tank group 402 (composed of the second tanks 77 of the respective elements 7), and an aligned first central pipe-receiving hole group 26 (composed of the first pipe-receiving holes 20 of the respective elements 7). The U-shaped channels 79 of the respective elements 7 define a flow passage having two paths (a forward path and a return path) extending between the first and second tank groups 401, 402. The second heat exchanger element group 500 includes solely the second heat exchanger elements 8 laminated together and includes a third tank group 501 (composed of the third tanks 86 of the respective elements 8), a fourth tank group 502 (composed of the fourth tanks 87 of the respective elements 8), and an aligned second central pipe-receiving hole group 26 (composed of the pipe-receiving holes 21 of the respective elements 8). The U-shaped channels 89 of the respective elements 8 define a flow passage having two paths (a forward path and a return path) extending between the third and fourth tank groups 501, 502.

Figure 11:
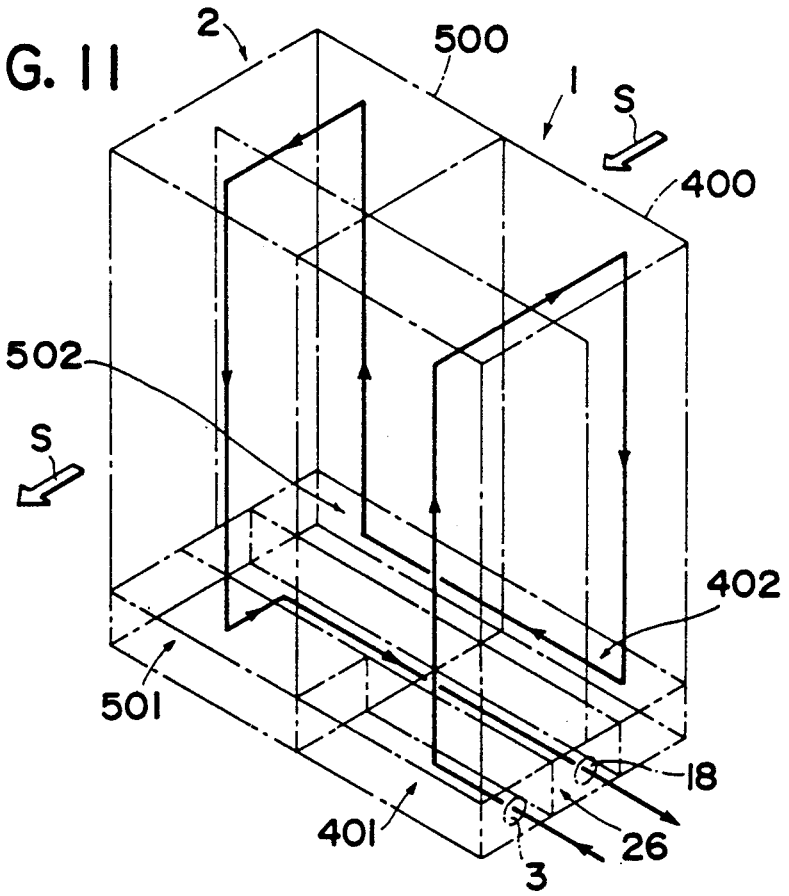
FIG. 11 is a diagrammatical view showing the flow of a refrigerant in the modified heat exchanger.

An inlet/outlet pipe 18 is received in the pipe-receiving hole group 26 of the first heat exchanger element group 400 and have an inner end extending in the pipe-receiving holes 21 of at least an innermost one of the second heat exchanger element 8 of the second heat exchanger element group 500. In the illustrated embodiment, the inlet/outlet pipe 18 is integral with an outlet pipe. With the heat exchanger 1 thus assembled, as shown in FIG. 11, the refrigerant supplied from the inlet pipe 3 into the first tank group 401 of the first heat exchanger element group 400 flows through the U-shaped channels 79 into the second tank group 402 from which the refrigerant horizontally moves to the fourth tank group 502 of the second heat exchanger element group 500. Subsequently, the refrigerant flows through the U-shaped channels 89 into the third tank groups 501 from which it flows into the inlet/outlet pipe 18. Finally, the refrigerant is discharged from the inlet/outlet pipe 18. The refrigerant as it flows through the heat exchanger 1 advances along a flow passage having four paths. The inlet pipe 3 and the inlet/outlet pipe 18 are interchangeable in function so that it is possible to supply the refrigerant from the inlet/outlet pipe 18 and then discharge from the pipe 3.

Figure 12:
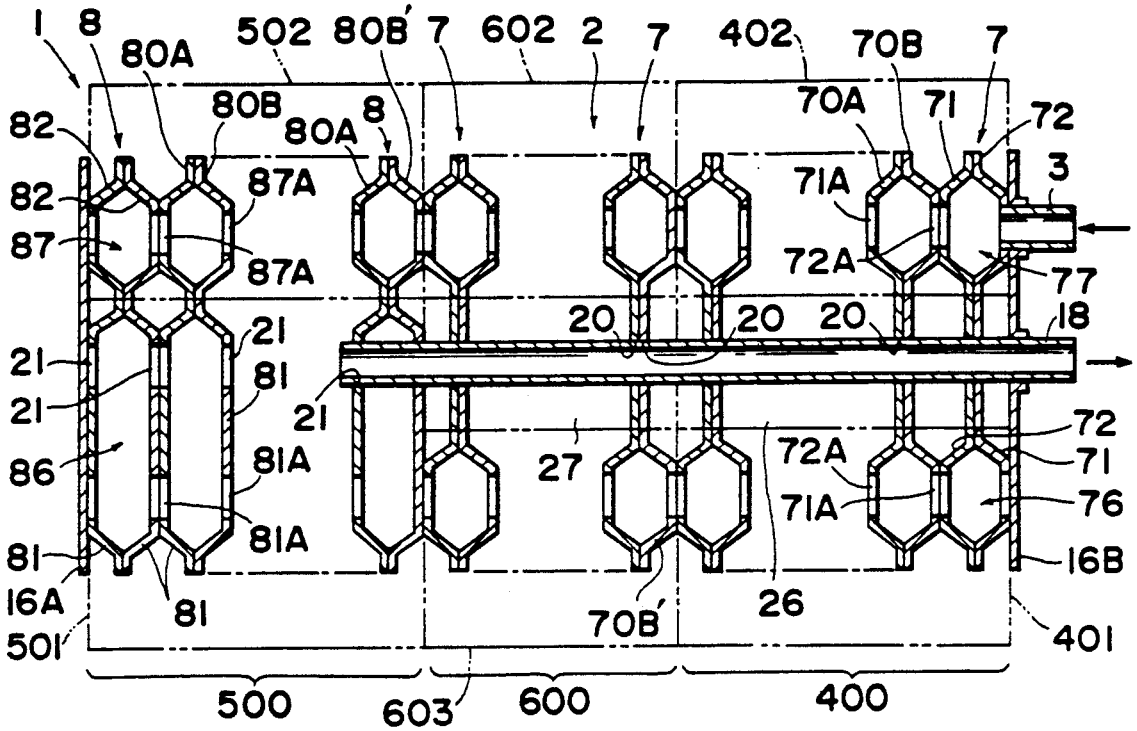
FIG. 12 a view similar to FIG. 10 but showing the construction of tanks of another modified heat exchanger.

FIG. 12 shows a heat exchanger having a six-path refrigerant flow passage. This heat exchanger is structurally similar to the six-path heat exchanger shown in FIG. 6 and includes a third heat exchanger element group 600 disposed between the first and second heat exchanger element groups 400, 500 stated above with reference to the embodiment shown in FIG. 10.

More specifically, the body 2 of the heat exchanger 1 differs from that of the four-path heat exchanger shown in FIG. 10 in that the third heat exchanger element group 600 is added. The third heat exchanger element group 600 is the same as the first heat exchanger element group 400 and composed solely of the first heat exchanger elements 7 laminated together. The third heat exchanger element group 600 includes a fifth tank group 601 (composed of the first tanks 76 of the respective elements 7), a sixth tank group 602 (composed of the second tanks 77 of the respective elements 7), and an aligned third pipe-receiving hole group 27 (composed of the pipe-receiving holes 20 in the respective elements 7). The U-shaped channels 79 of the respective elements 7 define a flow passage having two paths (a forward path and a return path) extending between the fifth and sixth tank groups 601, 602.

An inlet/outlet pipe 18 is received in the first and third aligned pipe-receiving hole groups 26, 27, respectively, of the first and third heat exchanger element groups 400, 600 and have an inner end extending in the pipe-receiving holes 21 of at least an innermost one of the second heat exchanger element 8 of the second heat exchanger element group 500. In the illustrated embodiment, the inlet/outlet pipe 18 is integral with the outlet pipe.

Figure 13:
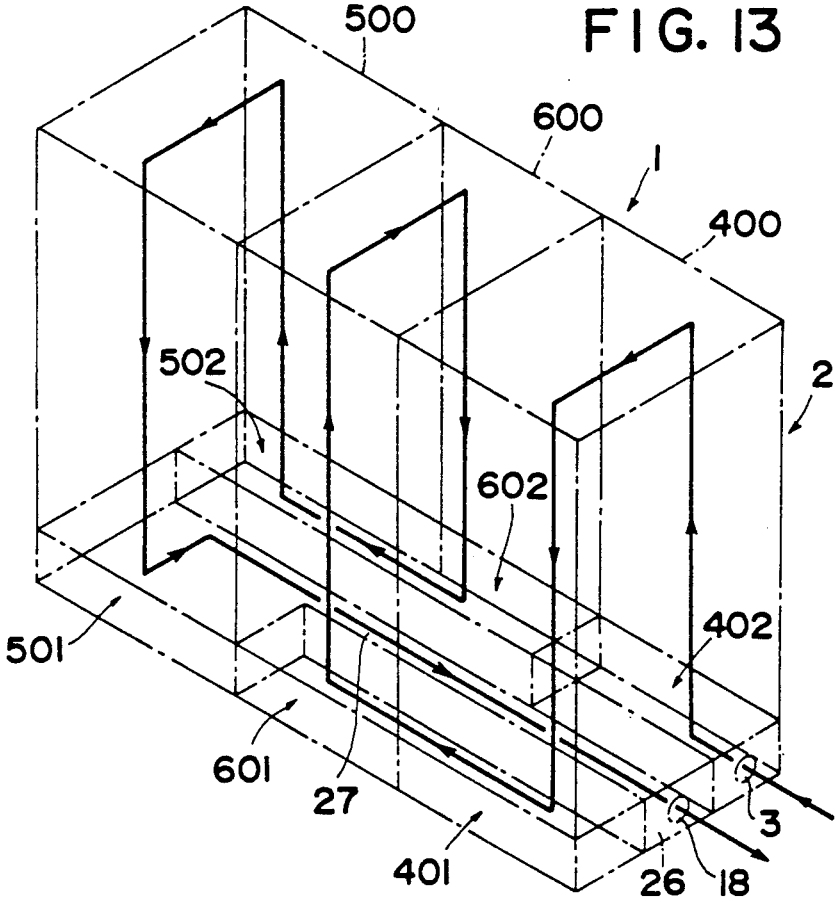
FIG. 13 is a diagrammatical view showing the flow of a refrigerant in the heat exchanger shown in FIG. 12.

With the heat exchanger 1 thus assembled, as shown in FIG. 13, the refrigerant supplied from the inlet pipe 3 into the second tank group 402 of the first heat exchanger element group 400 flows through the U-shaped channels 79 into the first tank group 401 from which the refrigerant horizontally moves into the fifth tank group 601 of the third heat exchanger element group 600. Subsequently, the refrigerant flows through the U-shaped channel 79 into the sixth tank group 602 from which it flows horizontally into the fourth tank group 502 of the second heat exchanger element group 500. Thereafter, the refrigerant flows through the U-shaped channels 89 into the third tank groups 501 from which it flows into the inlet/outlet pipe 18. Finally, the refrigerant is discharged from the inlet/outlet pipe 18. The refrigerant as it flows through the heat exchanger 1 advances along a flow passage having six paths. The inlet pipe 3 and the inlet/outlet pipe 18 are interchangeable in function so that it is possible to supply the refrigerant from the inlet/outlet pipe 18 and then discharge from the pipe 3.

The four-path heat exchanger and the sixth-path heat exchanger shown in FIG. 10 and FIG. 12, respectively, is constructed by connecting a plurality of two-path refrigerant flow passages in the respective heat exchanger element groups in series. The inlet and outlet pipes are disposed in juxtaposition on a same side of the heat exchanger body.

Figure 14:
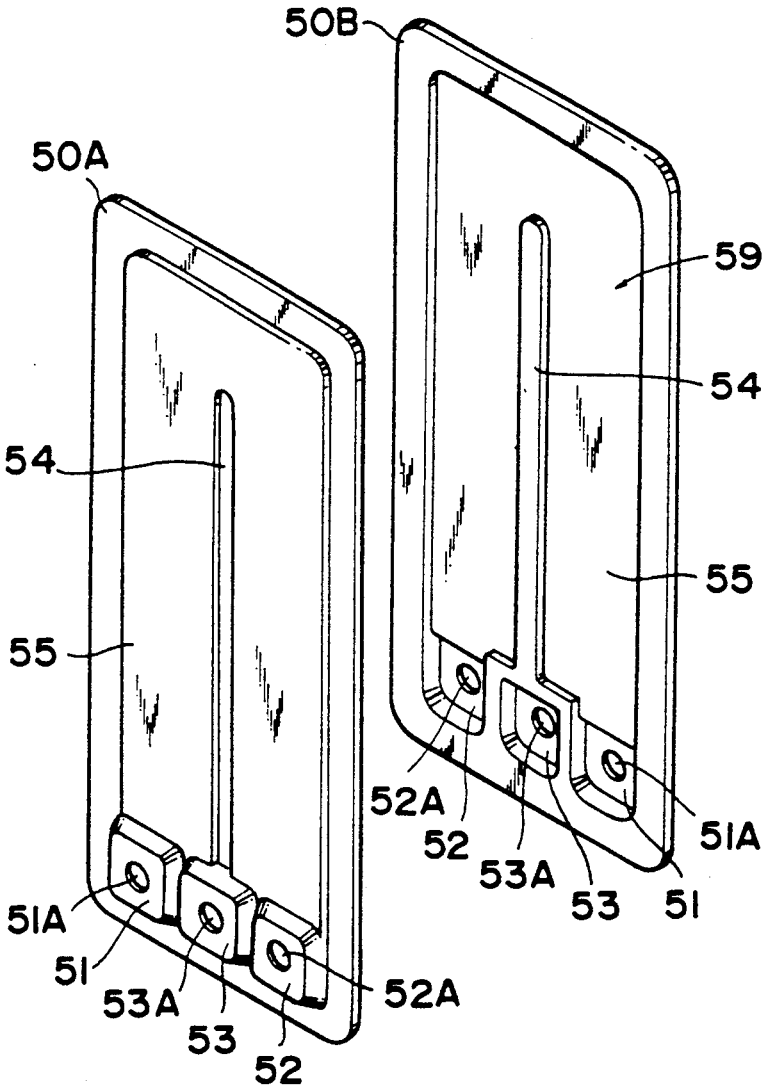
FIG. 14 is an exploded perspective view of a heat exchanger element composed of a pair of press-formed plates adapted to be assembled layerwise to form part of a laminated heat exchanger according to the invention.
Figure 15:
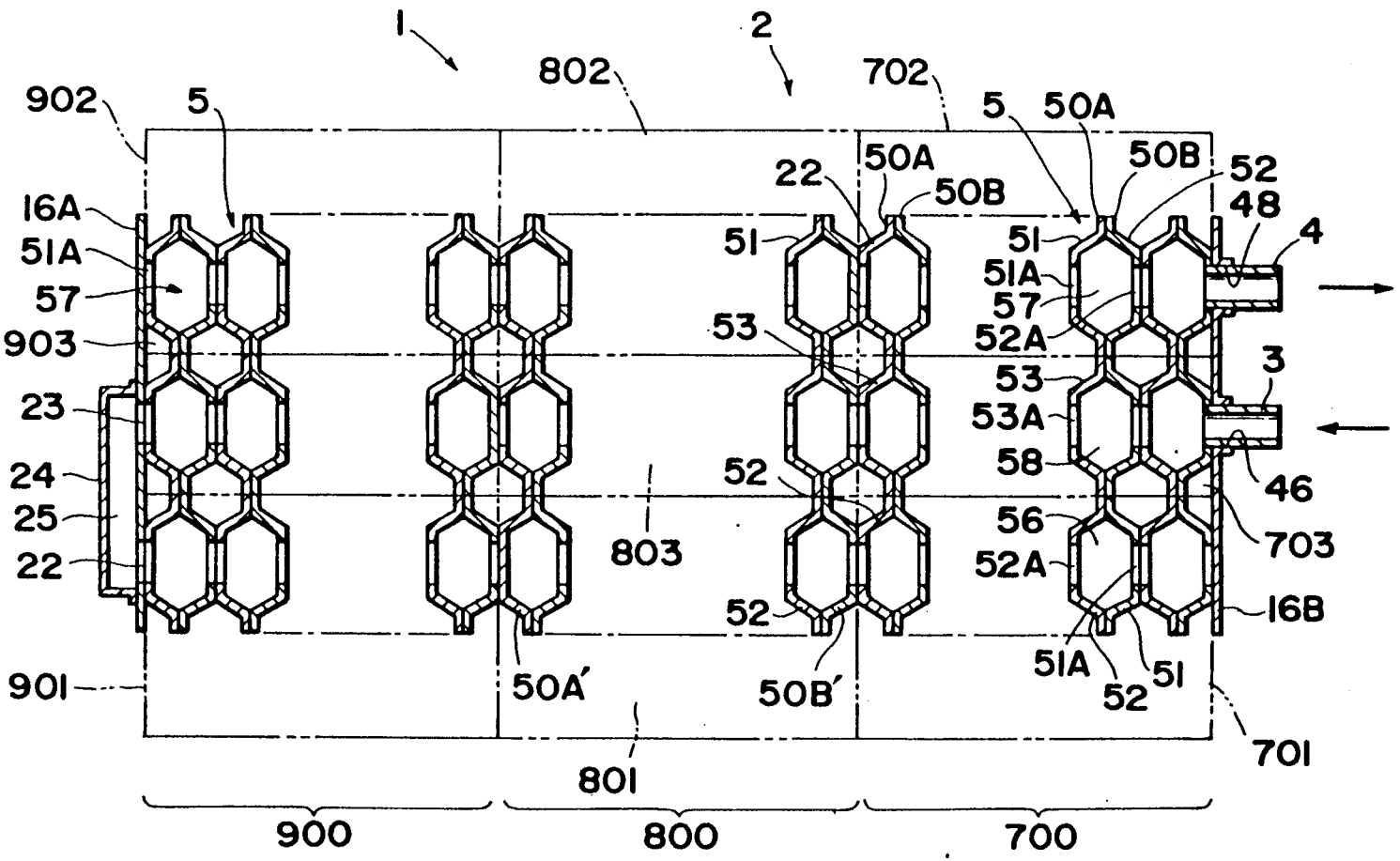
FIG. 15 is a horizontal cross-sectional view showing the construction of tanks of the laminated heat exchanger including the press-formed plates shown in FIG. 14.
Figure 16:
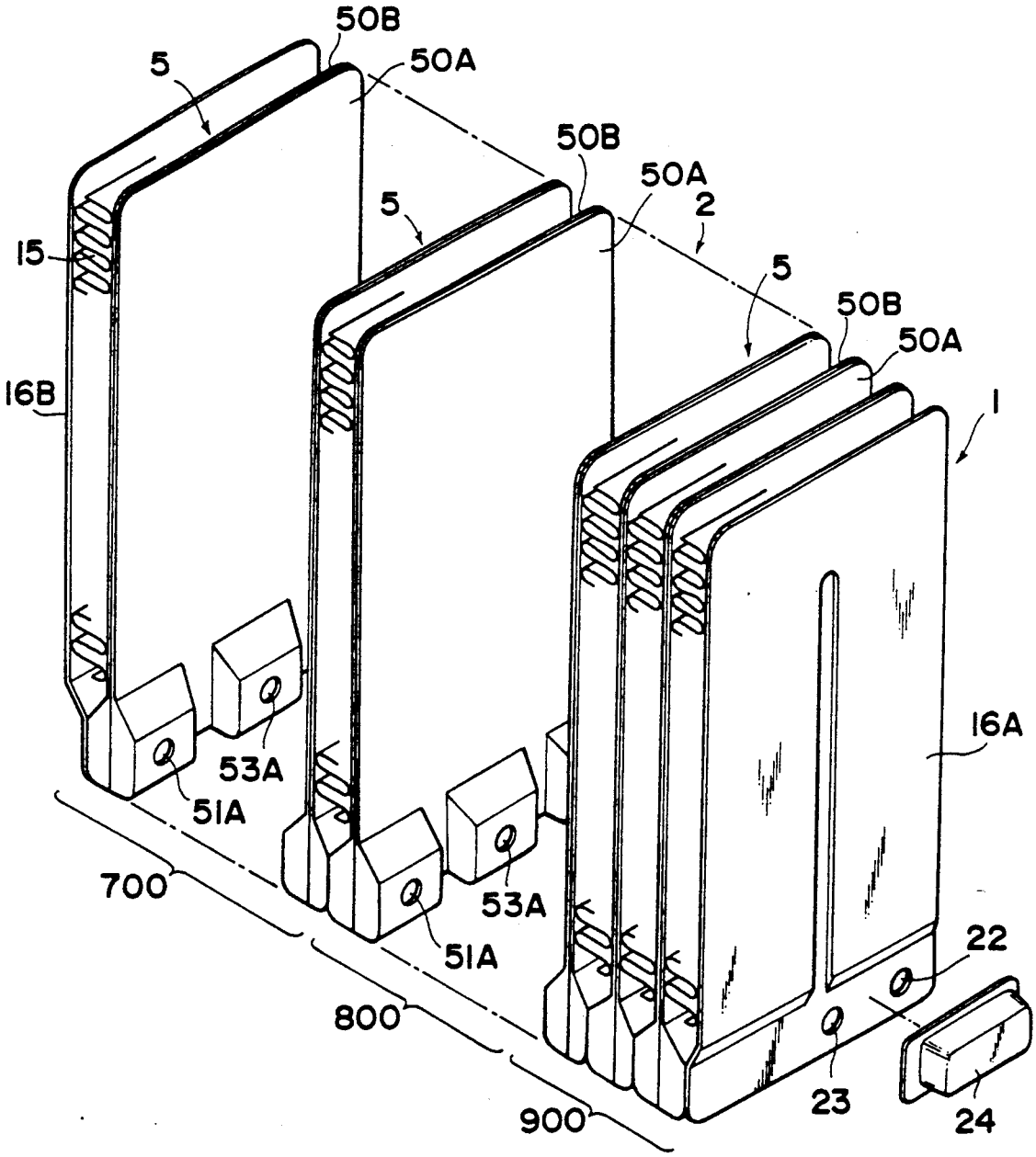
FIG. 16 is a perspective view of the heat exchanger shown in FIG. 15.

FIG. 14 shows a pair of stamped or otherwise press-formed elongate plates 50A, 50B which is the same as the pair of press-formed plates used for the formation of the first heat exchanger element 5 shown in FIG. 1. Due to such identical structure, a description of the plates 50A, 50B is no longer needed. These press-formed plates 50A, 50B are joined together face to face to form a heat exchanger element 5. A plurality of such heat exchanger elements 5 are arranged in a laminated condition as shown in FIG. 15, thereby forming the body 2 of a heat exchanger 1. The heat exchanger body 2 is separated into three groups, that is first, second and third heat exchanger element groups 700, 800, 900. Each of the first to third heat exchanger element groups 700–900 has a pair of tank groups 701, 801 or 901 (composed of the first tanks 56 of the respective elements 5) and 702, 802 or 902 (composed of the second tanks 57 of the respective elements 5), and a central tank group 703, 803 or 903 (composed of the central third tanks 58 of the respective elements 5). The U-shaped channels 59 of the respective elements 5 of each heat exchanger element group 700, 800, 900 define a refrigerant flow passage having two paths (a forward path and a return path) and extending between the opposite tank groups 701 and 702, 801 and 802 or 901 and 902. The tank group 701 of the first heat exchanger element group 700 is connected with the tank group 801 of the second heat exchanger element group 800, and the tank group 802 of the second heat exchanger element group 800 is connected with the tank group 902 of the third heat exchanger element group 900 to that the two-path refrigerant flow passages of the respective heat exchanger element groups 700, 800, 900 are connected together in series. As a result, a combined refrigerant flow passage thus formed has six paths. The six-path refrigerant flow passage is connected at its one end with one end of the series-connected central tank groups 703, 803, 903 by a pair of holes 22, 23 formed in the end plate 16A in alignment with the outer first tank 56 and the central third tank 58, respectively, and also by a cover 24 attached to the end plate 16A and defining a connecting passage 25 interconnecting the two holes 22, 23. The cover 24 has a rectangular open-box shape, as shown in FIG.16, and is connected to the end plate 16A with its open end edge abutting on the outer surface of the end plate 16A. The opposite end of the six-path refrigerant flow path is connected to an outlet pipe 4. The opposite end 703 of the series-connected tank groups 703, 803, 903 is connected to an inlet pipe 3. The tank group 901 and the tank group 801 are separated by a press-formed elongate plate 50A' which is devoid of a hole 52A extending through a recess 52. Likewise, the tank group 802 and the tank group 702 are separated by another press-formed elongate plate 50B' which is devoid of a hole 52A extending through the recess 52. The inlet pipe 3 and the outlet pipe 4 are fitted in an inlet hole 46 and an outlet hole 48, respectively, which are formed in the end plate 16B in laterally spaced relation to one another. The end plate 16B closes the right hole 51A of the tank 56 of the outermost heat exchanger element 5 which is held against the end plate 16B. The end plate 16A closes the left hole 51A of the tank 57 of the outermost heat exchanger element 5 which is held against the end plate 16A.

Figure 17:
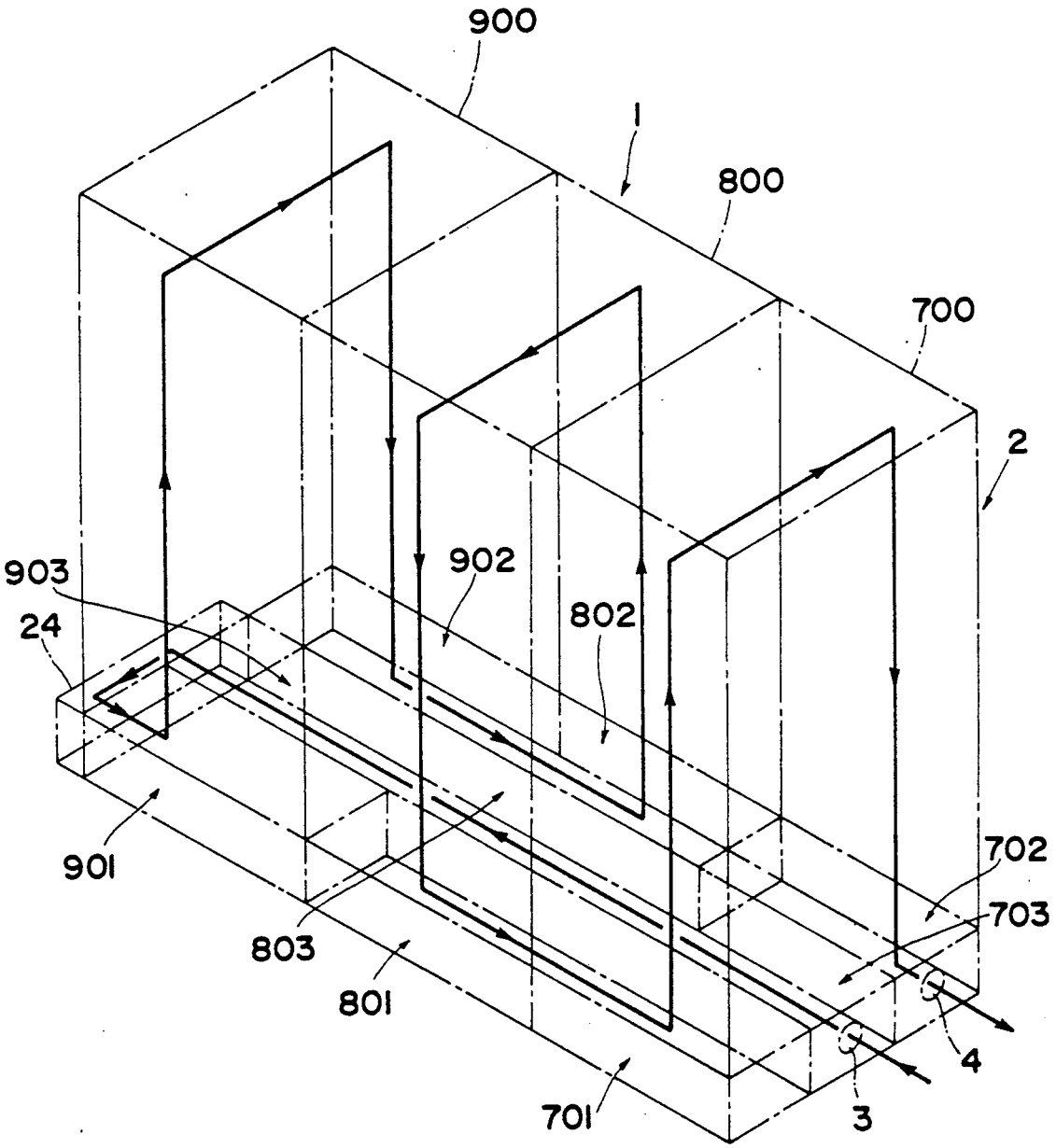
FIG. 17 is a diagrammatical view showing the flow of a refrigerant in the heat exchanger of FIG. 16.

With the heat exchanger 1 thus assembled, as shown in FIG. 17, the refrigerant supplied from the inlet pipe 3 into the central tank group 703 flows straight through the succeeding central tank groups 803, 903 and moves into the tank group 901 of the third heat exchanger element group 900 through the connecting passage 25 defined by the cover 24. Subsequently, the refrigerant flows through the U-shaped channels 59 into the opposite tank group 902 from which the refrigerant horizontally moves into the tank group 802 of the second heat exchanger element group 800. Thereafter, the refrigerant flows through the U-shaped channel 59 to the tank group 801 from which it advances horizontally to the tank group 701 of the first heat exchanger element group 700. Then, the refrigerant flows through the U-shaped channel 59 into the tank group 702 from which it is discharged through the outlet pipe 4. The refrigerant as it flows through the heat exchanger 1 advances along a flow passage having six paths. The inlet pipe 3 and the outlet pipe 4 are interchangeable in function so that it is possible to supply the refrigerant from the pipe 4 and then discharge from the pipe 3. The sixth-path heat exchanger shown in FIG. 17 is constructed by connecting a plurality of two-path refrigerant flow passages in the respective heat exchanger element groups 700, 800, 900 in series. Since the six-path refrigerant flow passage is connected at its one end to the series-connected central tank groups 903, 803, 703 by the cover 24 attached to the end plate 16A, the inlet and outlet pipes 3, 4 are disposed in juxtaposition on a same side of the heat exchanger body.

Figure 18:
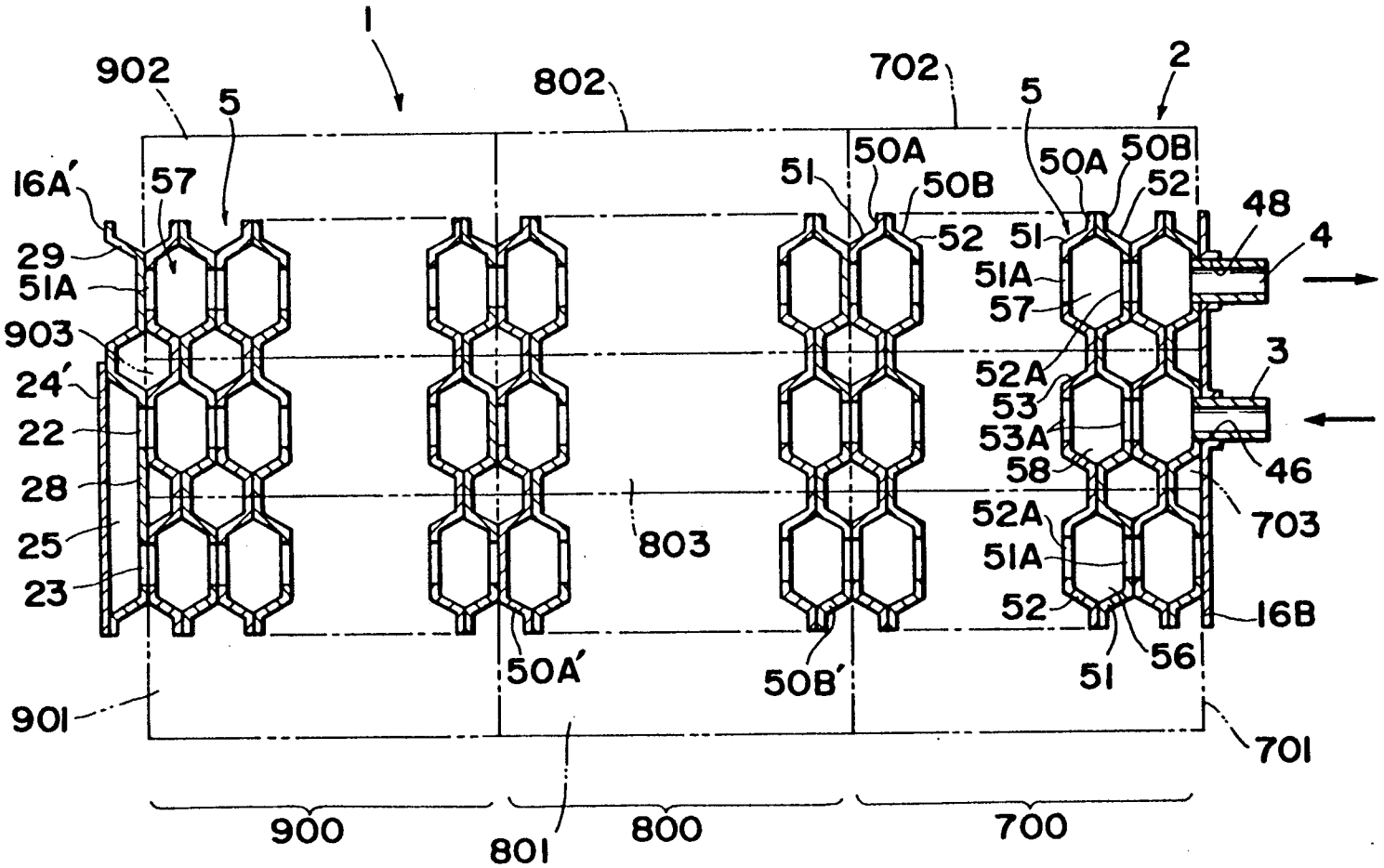
FIG. 18 is a horizontal cross-sectional view of a modified heat exchanger, showing the construction of tanks.

FIG. 18 shows a modified heat exchanger having a six-path refrigerant flow path. These parts which are identical to those shown in FIG. 15 are designated by the identical reference characters without a further description.

Figure 19:
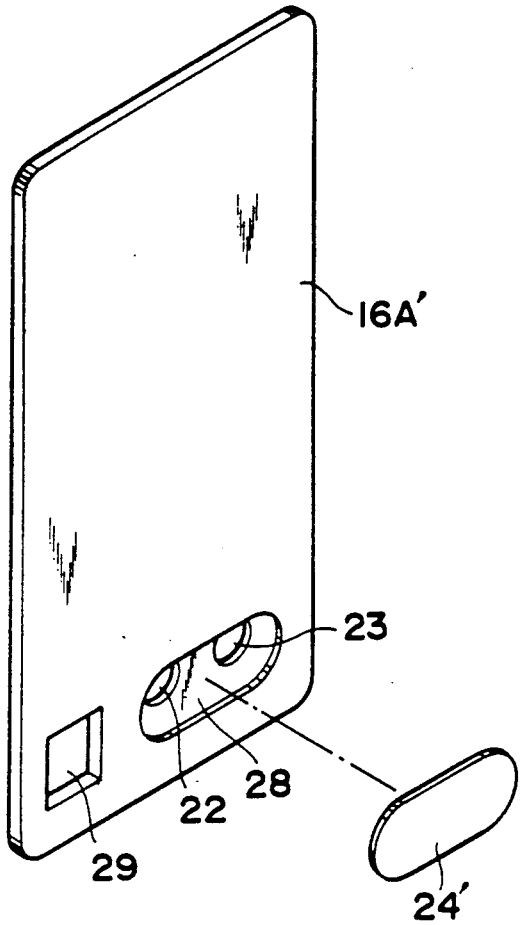
FIG. 19 is a perspective view of an end plate of the modified heat exchanger.

The heat exchanger shown in FIG. 18 differs from the heat exchanger shown in FIG. 15 in that the heat exchanger body 2 is provided with an end plate 16A' in place of the end plate 16A. The end plate 16A' includes, as shown in FIG. 19, an elongate first recess 28 having a pair of spaced holes 22, 23, and a rectangular second recess 29 which is free of a hole. A cover 24' is attached to the end plate 16A' to close the recess 28. As shown in FIG. 18, the end plate 16A' with the cover 24' attached thereto is disposed on the left end of the heat exchanger body 2 so that the tank group 901 of the third heat exchanger element group 900 is connected to the series-connected central tank groups 903, 803, 703 by a connecting passage 25 defined by and between the recess 28 and the cover 24'. The recess 29 closes the left hole 51A of the tank 57 of the third heat exchanger element group 900.

Figure 20:
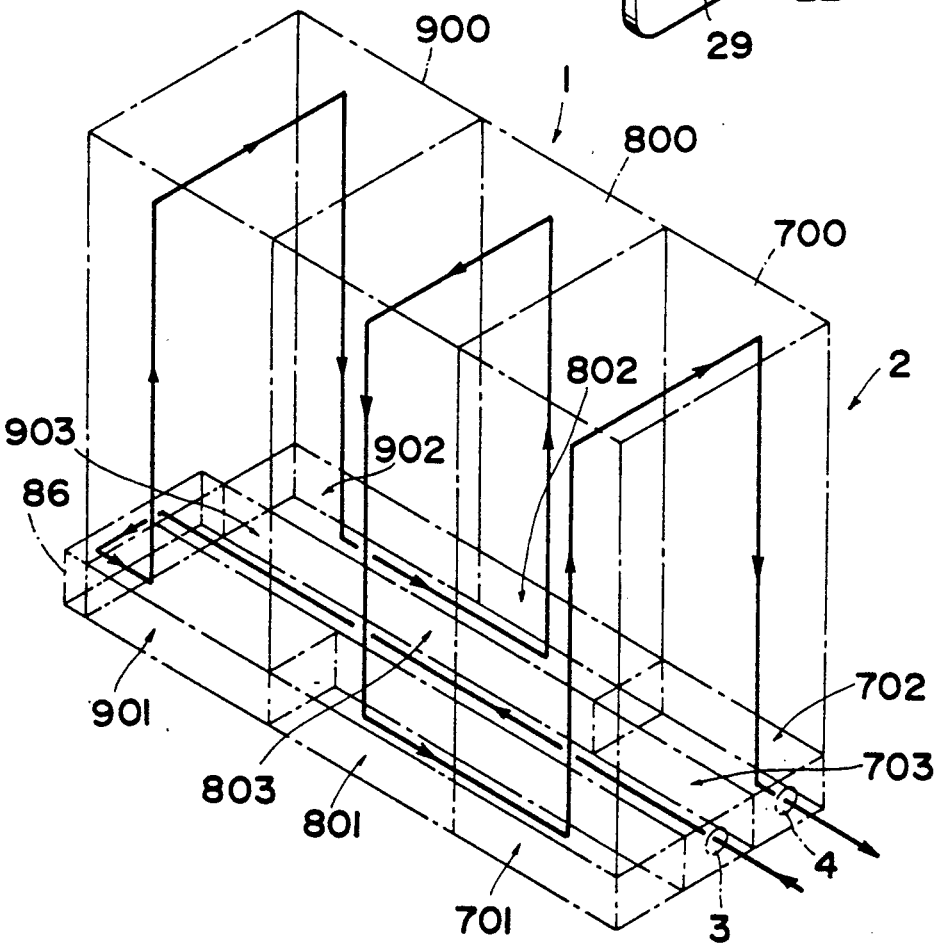
FIG. 20 is a diagrammatical view showing the flow of a refrigerant in the heat exchanger shown in FIG. 18.

With the heat exchanger 1 thus assembled, as shown in FIG. 20, the refrigerant supplied from the inlet pipe 3 into the central tank group 703 flows straight through the succeeding central tank groups 803, 903 and moves into the tank group 901 of the third heat exchanger element group 900 through the connecting passage 25 defined by the recess 29 and the cover 24'. Subsequently, the refrigerant flows through the U-shaped channels 59 into the opposite tank group 902 from which the refrigerant horizontally moves into the tank group 802 of the second heat exchanger element group 800. Thereafter, the refrigerant flows through the U-shaped channel 59 to the tank group 801 from which it advances horizontally to the tank group 701 of the first heat exchanger element group 700. Then, the refrigerant flows through the U-shaped channel 59 into the tank group 702 from which it is discharged through the outlet pipe 4. The refrigerant as it flows through the heat exchanger 1 advances along a flow passage having six paths. The inlet pipe 3 and the outlet pipe 4 are interchangeable in function so that it is possible to supply the refrigerant from the pipe 4 and then discharge from the pipe 3. The six-path heat exchanger shown in FIG. 18 is constructed by connecting a plurality of two-path refrigerant flow passages in the respective heat exchanger element groups 700, 800, 900 in series. Since the six-path refrigerant flow passage is connected at its one end to the series-connected central tank groups 903, 803, 703 by the connecting passage 25 defined by and between the recess 28 in the end plate 16A' and the cover 24', the inlet and outlet pipes 3, 4 are disposed in juxtaposition on a same side of the heat exchanger body.

Figure 21:
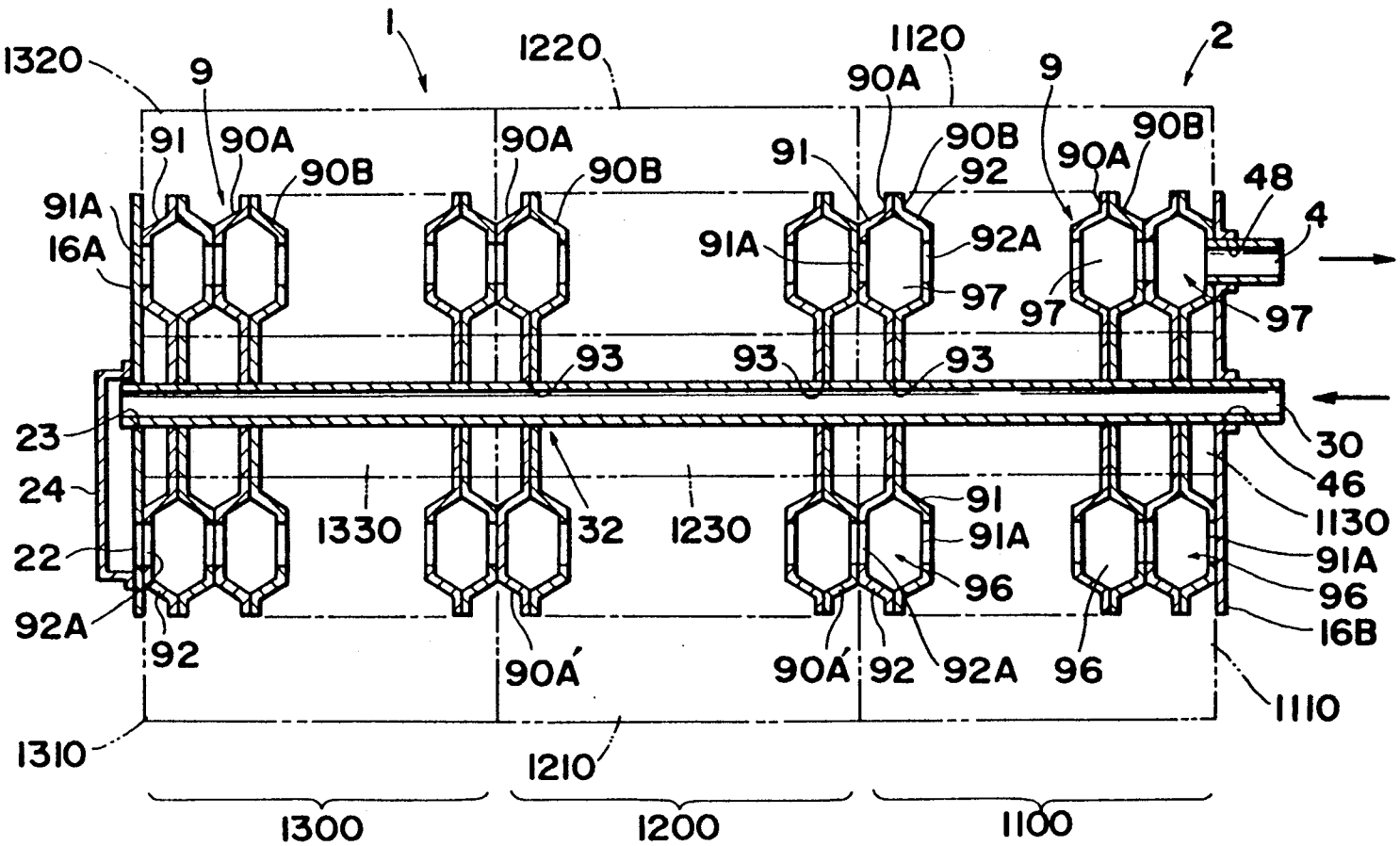
FIG. 21 is a horizontal cross-sectional view of a heat exchanger according to another embodiment, the view showing the construction of tanks.

FIG. 21 shows a modified heat exchanger having a six-path refrigerant flow passage. The heat exchanger 1 includes a body 2, an inlet/outlet pipe 30 for supplying a refrigerant into the heat exchanger body 2, and an outlet pipe 4 for discharging the refrigerant from the heat exchanger body 2. The inlet/outlet pipe 30 and the outlet pipe 4 are connected to one side of the heat exchanger body 2 and they are interchangeable in function. The heat exchanger body 2 and the pipes 30, 4 are joined together by brazing in an oven.

The heat exchanger body 2 is composed of a plurality of heat exchanger elements 9 laminated together with corrugated fins 15 disposed therebetween, and two end plates 16A, 16B connected to outermost ones of the heat exchanger elements 9.

Figure 22:
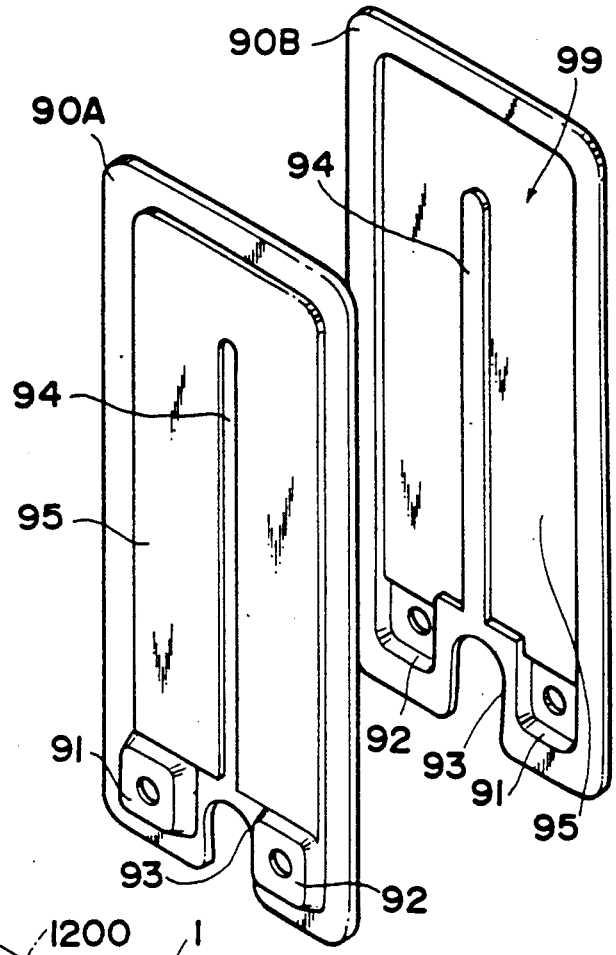
FIG. 22 is an exploded perspective view of a heat exchanger element composed of a pair of press-formed plates adapted to be laminated to form a part of the heat exchanger shown in FIG. 21.

Each of the heat exchanger elements 9 is composed of a pair of stamped or otherwise press-formed elongate plates 90A and 90B (FIG. 22) joined together in face-to-face confrontation. The press-formed plates 90A, 90B are similar to the press-formed plates 50A, 50B shown in FIG. 14 but different therefrom in that a U-shaped pipe-receiving cutout opening 93 is provided in place of the central recess 53. When the two press-formed plates 90A, 90B are joined together in face-to-face confrontation, a heat exchanger element 9 is formed. The heat exchanger element 9 has defined within it a first tank 96 defined by the opposed recesses 91, 92, a second tank 97 defined by the opposed recesses 92, 91, a pipe receiving portion 32 defined by the two pipe-receiving cutout recesses 93 connected end to end, and a U-shaped channel 99 defined by the two opposed U-shaped grooves 95. The recesses 91, 92 of the plates 90A, 90B have central holes 91A, 92A so that plural heat exchanger elements 9 are laminated together, the first tanks and the second tanks respectively of each adjacent pair of the laminated heat exchanger elements 9 communicate with each other through the holes 91A, 92A.

The heat exchanger body 2 composed of the laminated heat exchanger elements 9 are separated into three groups, that is, a first group of heat exchanger elements 1100, a second group of heat exchanger elements 1200, and a third group of heat exchanger elements 1300. Each of the first, second and third heat exchanger element groups 1100, 1200, 1300 has a first tank group 1110, 1210, 1310 (composed of the tanks 96 of the respective elements 9), a second tank group 1120, 1220, 1320 (composed of the tanks 97 of the respective elements 9), a refrigerant flow passage extending between the first and second tank groups 1110 and 1120, 1210 and 1220, 1310 and 1320 along the U-shaped channels 99 of the respective elements 9, and a central pipe-receiving passage group 1130, 1230, 1330 defined by the pipe-receiving portions 93 of the respective elements 9 aligned in the direction of lamination of the elements 9, the refrigerant flow passage having two paths (a forward path and a return path). The first tank group 1110 of the first heat exchanger element group 1100 is connected with the first tank group 1210 of the second heat exchanger element group 1200 at two adjacent tanks, and the second tank group 1220 of the second heat exchanger element group 1200 is connected with the second tank group 1320 of the third heat exchanger element group 1300. Thus, the two-path refrigerant flow passages of the respective heat exchanger element groups 1100, 1200, 1300 are connected together in series so that a combined refrigerant flow passage having six paths is formed. The inlet/outlet pipe 30 is fitted in the pipe-receiving passage groups 1130, 1230, 1330 and the hole 23 of the end plate 16A. One end of the inlet/outlet pipe 30 is communicated with the first tank group 1310 by a connecting passage defined by a box-like cover 24 and extending between the holes 23, 22, the first tank group 1310 constituting one end of the six-path refrigerant flow passage. The box-like cover 24 is identical to the cover 24 used in the heat exchanger shown in FIG. 15 and its open end edge is held in abutment with the outer surface of the end plate 16A. The second tank group 1120 which constitutes the opposite end of the six-path refrigerant flow passage is connected to the outlet pipe 4. The tank group 1120 and the tank group 1220 and the tank group 1210 and the tank group 1310 are separated respectively by two press-formed elongate plates 9OA'. Unlike the plate 90A, the plates 90A' do not have a hole defined in the recess 91. The outlet pipe 4 is fitted in an outlet hole 48 formed in the end plate 16B in laterally spaced relation to the inlet/outlet pipe 30. The end plate 16B closes the right hole 92A of the tank 96 of the outermost heat exchanger element 9 abutting thereagainst, while the end plate 16A closes the left hole 91A of the tank 97 of the outermost heat exchanger element 9 abutting thereagainst.

Figure 23:
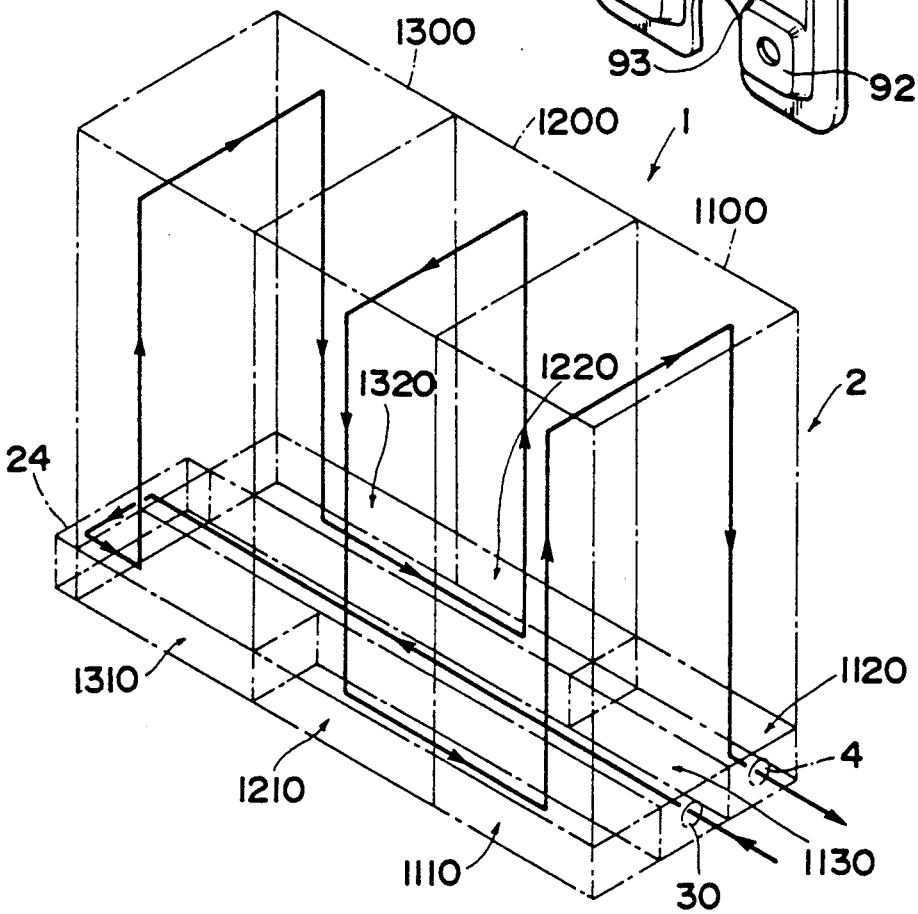
FIG. 23 is a diagrammatical view showing the flow of a refrigerant in the heat exchanger shown in FIG. 21.

With the heat exchanger 1 thus assembled, as shown in FIG. 23, the refrigerant supplied from the inlet/outlet pipe 30 flows into the first tank group 1310 of the third heat exchanger element group 1300 through the connecting passage defined by the cover 24 and subsequently moves through the U-shaped passage 99 to the second tank group 1320 from which the refrigerant horizontally moves into the second tank group 1220 of the second hat exchanger element group 1200. Thereafter, the refrigerant flows through the U-shaped channel 99 to the first tank group 1210 from which it advances horizontally to the first tank group 1110 of the first heat exchanger element group 1100. Then, the refrigerant flows through the U-shaped channel 99 into the second tank group 1120 from which it is discharged through the outlet pipe 4. The refrigerant as it flows through the heat exchanger 1 advances along a flow passage having six paths. The inlet/outlet pipe 30 and the outlet pipe 4 are interchangeable in function so that it is possible to supply the refrigerant from the pipe 4 and then discharge from the pipe 30. The six-path heat exchanger shown in FIG. 21 is constructed by connecting a plurality of two-path refrigerant flow passages in the respective heat exchanger element groups 1100, 1200, 1300 in series. Since the six-path refrigerant flow passage is connected at its one end to the inlet/outlet pipe 30 via the connecting passage defined by the cover 24 attached to the end plate 16A, it is possible to disposed the pipes 30, 4 in juxtaposition on the same side of the heat exchanger body.

Obviously, various modifications and variations of the present invention are possible in the light of the above teaching. It is therefore to be understood that within the scope of the appended claims the present invention may be practiced otherwise than as specifically described.

What is claimed is:

1. A laminated heat exchanger comprising:

a plurality of first heat exchanger elements, each said first heat exchanger element including a pair of first and second tanks, a first U-shaped channel interconnecting said first and second tanks, and a central third tank disposed between said first and second tanks and separated from said first and second tanks;

a plurality of second heat exchanger elements, each said second heat exchanger element including a pair of fourth and fifth tanks, a second U-shaped channel interconnecting said fourth and fifth tanks, and a central sixth tank disposed between said fourth and fifth tanks and communicating with one of said fourth and fifth tanks; and a plurality of corrugated fins;

said first heat exchanger elements and a part of said plural corrugated fins being laminated alternately, with said first tanks, second tanks and third tanks of each adjacent pair of the laminated first heat exchanger elements communicating with each other, said laminated first heat exchanger elements having a first internal refrigerant flow passage extending between said first and second tanks and having a forward path and a return path;

said second heat exchanger elements and the remainder of said corrugated fins being laminated alternately, with said fourth tanks, fifth tanks and sixth tanks of each adjacent pair of the laminated second heat exchanger elements communicating with each other, said laminated second heat exchanger elements having a second internal refrigerant flow passage extending between said fourth and fifth tanks and having a forward path and a return path;

said laminated first heat exchanger elements and said laminated second heat exchanger elements being connected end to end, with said third tank of an endmost one of the laminated first heat exchanger elements communicating with said sixth tank of a confronting one of the laminated second heat exchanger elements so that said third and sixth tanks jointly forming a group of central tanks connected in series;

one of said first and second tanks of said endmost first heat exchanger element communicating with the other of said fourth and fifth tanks of said confronting second heat exchanger element to connect said first and second internal refrigerant flow passages in series to thereby form a combined refrigerant flow passage having two forward paths and two return paths, said combined refrigerant flow passage being connected at one end with an end of said group of series-connected central tanks.

2. A laminated heat exchanger according to claim 1 wherein each said first heat exchanger element is composed of a pair of first press-formed elongate plates joined together in confrontation, each said first press-formed elongate plate having three recesses along one end edge thereof, a longitudinal ridge extending from a central one of said three recesses toward the opposite end edge, and a U-shaped groove extending between two outer ones of said three recesses along the periphery of said longitudinal ridge, said U-shaped groove having a depth smaller than the depth of said three recesses, each said three recesses having a central hole.

3. A laminated heat exchanger according to claim 1 wherein each said second heat exchanger element is composed of a pair of second press-formed elongate plates joined together in confrontation, each said second press-formed elongate plate having three recesses along one end edge thereof, a longitudinal ridge extending from a central one of said three recesses toward the opposite end edge, and a U-shaped groove extending between two outer ones of said three recesses along the periphery of said longitudinal ridge, said U-shaped groove having a depth smaller than the depth of said three recesses, each said three recesses having a central hole, said central recess communicating with one of said outer recesses.

4. A laminated heat exchanger according to claim 2 or 3 wherein said central holes in the respective recesses communicate the corresponding tanks of the adjacent heat exchanger elements.

5. A laminated heat exchanger according to claim 3 wherein said combined refrigerant flow passage and said central tank group are connected together by said sixth tank and said one of the fourth and fifth tanks of an endmost one of said laminated second heat exchanger elements which is remote from said confronting second heat exchanger element.

6. A laminated heat exchanger comprising:

a plurality of first heat exchanger elements, each said first heat exchanger element including a pair of first and second tanks, a first U-shaped channel interconnecting said first and second tanks, and a pair of aligned first pipe-receiving holes disposed between said first and second tanks and separated from said first and second tanks;

a plurality of second heat exchanger elements, each said second heat exchanger element including a pair of fourth and fifth tanks, a second U-shaped channel interconnecting said fourth and fifth tanks, and a pair of aligned second pipe-receiving holes formed in one of said fourth and fifth tanks;

a plurality of corrugated fins;

said first heat exchanger elements and a part of said plural corrugated fins being laminated alternately, with said first tanks and second tanks of each adjacent pair of said laminated first heat exchanger elements communicating with each other, and also with said first pipe-receiving holes of each adjacent pair of said laminated first heat exchanger elements aligned with each other, said laminated first heat exchanger elements having a first internal refrigerant flow passage extending between said first and second tanks and having a forward path and a return path;

said second heat exchanger elements and the remainder of said corrugated fins being laminated alternately, with said fourth tanks and fifth tanks of each adjacent pair of the laminated second heat exchanger elements communicating with each other, and also with said second pipe-receiving holes aligned with each other, said laminated second heat exchanger elements having a second internal refrigerant flow passage extending between said fourth and fifth tanks and having a forward path and a return path;

said laminated first heat exchanger elements and said laminated second heat exchanger elements being connected end to end, with said first and second pipe-receiving holes aligned one another to form a series of pipe-receiving holes;

one of said first and second tanks of said endmost first heat exchanger element communicating with the other of said fourth and fifth tanks of said confronting second heat exchanger element to connect said first and second internal refrigerant flow passages in series to thereby form a combined refrigerant flow passage having two forward paths and two return paths; and an inlet/outlet pipe extending through said series of pipe-receiving holes and connected at its one end to one end of said combined refrigerant flow passage.

7. A laminated heat exchanger according to claim 6 wherein each said first heat exchanger element is composed of a pair of first press-formed elongate plates joined together in confrontation, each said first press-formed elongate plate having two laterally spaced recesses along one end edge thereof, one of said aligned first pipe-receiving holes disposed between said two recesses, a longitudinal ridge extending from said pipe-receiving opening toward the opposite end edge of said first press-formed elongate plate, and a U-shaped groove extending between said two recesses along the periphery of said longitudinal ridge, said U-shaped groove having a depth smaller than the depth of said recesses, each said two recesses having a central hole.

8. A laminated heat exchanger according to claim 6 wherein each said second heat exchanger element is composed of a pair of second press-formed elongate plates joined together in confrontation, each said second press-formed elongate plate having two recesses along one end edge thereof, each of said two recesses having one hole, one of said two recesses having one of said aligned second pipe-receiving holes disposed between said holes in said two recesses, each said second press-formed elongate plate further having a longitudinal ridge extending from said pipe-receiving hole toward the opposite end edge thereof, and a U-shaped groove extending between said two recesses along the periphery of said longitudinal ridge, said U-shaped groove having a depth smaller than the depth of said three recesses.

9. A laminated heat exchanger according to claim 7 or 8 wherein said holes in the respective recesses communicate the corresponding tanks of the adjacent heat exchanger elements.

10. A laminated heat exchanger according to claim 6 wherein said one end of said inlet/outlet pipe opens to said one of said fourth and fifth tanks of an endmost one of said laminated second heat exchanger elements which is remote from said confronting second heat exchanger element, thereby connecting said combined refrigerant flow passage and said inlet/outlet pipe.

11. A laminated heat exchanger comprising:

a multiplicity of heat exchanger elements each including a pair of first and second tanks, a U-shaped channel interconnecting said first and second tanks, and a central third tank disposed between said first and second tanks and separated from said first and second tanks;

a plurality of corrugated fins laminated alternately with said heat exchanger elements;

two end plates disposed on two endmost ones of said laminated heat exchanger elements, respectively;

said laminated heat exchanger elements being composed of plural groups of heat exchanger elements which are connected by said first tanks and second tanks of each adjacent pair of the heat exchanger elements adequately communicating with each other so that each said group of heat exchanger elements has a internal refrigerant flow passage extending between said first and second tanks and having a forward path and a return path;

said third tanks of all said groups of heat exchanger elements being communicated with each other to form a series of central tanks:

one of said first tank and said second tank of an endmost one of the heat exchanger element of one group of heat exchanger elements communicating with a corresponding one of said first tank and said second tank of a confronting one of the heat exchanger element of an adjacent group of heat exchanger elements so as to connect said internal refrigerant flow passages of the respective groups of heat exchanger elements in series to form a combined refrigerant flow passage; and means on one of said end plates for connecting one end of said combined refrigerant flow passage and one end of said series of central tanks in series.

12. A laminated heat exchanger according to claim 11 wherein each said heat exchanger element is composed of a pair of press-formed elongate plates joined together in confrontation, each said first press-formed elongate plate having three recesses along one end edge thereof, a longitudinal ridge extending from a central one of said three recesses toward the opposite end edge, and a U-shaped groove extending between two outer ones of said three recesses along the periphery of said longitudinal ridge, said U-shaped groove having a depth smaller than the depth of said three recesses, each said three recesses having a central hole.

13. A laminated heat exchanger according to claim 11 wherein said connecting means comprises a portion of said one end plate defining a pair of holes, and a cover closing said holes, said holes communicating said hole in said one central tank with said hole in one of said first and second tanks of an endmost heat exchanger element which is laminated with said one end plate.

14. A laminated heat exchanger comprising:

a multiplicity of heat exchanger elements each including a pair of first and second tanks, a U-shaped channel interconnecting said first and second tanks, and a pair of aligned pipe-receiving openings disposed between said first and second tanks;

a plurality of corrugated fins laminated alternately with said heat exchanger elements;

two end plates disposed on two endmost ones of said laminated heat exchanger elements, respectively;

said laminated heat exchanger elements being composed of plural groups of heat exchanger elements which are connected by said first tanks and second tanks of each adjacent pair of the heat exchanger elements adequately communicating with each other so that each said group of heat exchanger elements has a internal refrigerant flow passage extending between said first and second tanks and having a forward path and a return path, and said pipe-receiving openings of said groups of heat exchanger elements are aligned with one another;

one of said first tank and said second tank of an endmost one of the heat exchanger element of one group of heat exchanger elements communicating with a corresponding one of said first tank and said second tank of a confronting one of the heat exchanger element of an adjacent group of heat exchanger elements so as to connect said internal refrigerant flow passages of the respective groups of heat exchanger elements in series to form a combined refrigerant flow passage;

an inlet/outlet pipe extending through said aligned pipe-receiving openings;

means on one of said end plates for connecting one end of said combined refrigerant flow passage and one end of said inlet/outlet pipe.

15. A laminated heat exchanger according to claim 14 wherein each said heat exchanger element is composed of a pair of press-formed elongate plates joined together in confrontation, each said first press-formed elongate plate having a pair of recesses along one end edge thereof, one of said pair of aligned pipe-receiving openings disposed between said recesses, a longitudinal ridge extending from said pipe-receiving opening toward the opposite end edge, and a U-shaped groove extending between said recesses along the periphery of said longitudinal ridge, said U-shaped groove having a depth smaller than the depth of said recesses, each said recesses having a central hole.

16. A laminated heat exchanger according to claim 14 wherein said connecting means comprises a portion of said one end plate defining a pair of holes, and a cover closing said holes, said holes communicating said inlet/outlet pipe with said hole in one of said first and second tanks of an endmost heat exchanger element which is laminated with said one end plate.

* * * * *